US007837315B2

(12) United States Patent
Mizutani et al.

(10) Patent No.: US 7,837,315 B2
(45) Date of Patent: Nov. 23, 2010

(54) CAVITY UNIT AND INK-JET RECORDING HEAD AND APPARATUS

(75) Inventors: Hiromitsu Mizutani, Ichinomiya (JP); Atsushi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1077 days.

(21) Appl. No.: 11/470,046

(22) Filed: Sep. 5, 2006

(65) Prior Publication Data

US 2007/0052780 A1 Mar. 8, 2007

(30) Foreign Application Priority Data

Sep. 5, 2005 (JP) ..... 2005-256393
Sep. 13, 2005 (JP) ..... 2005-265048

(51) Int. Cl.
*B41J 2/175* (2006.01)

(52) U.S. Cl. ..... 347/93

(58) Field of Classification Search ..... 347/93, 347/40; 422/100

See application file for complete search history.

(56) References Cited

U.S. PATENT DOCUMENTS 4,695,854 A * 9/1987 Cruz-Uribe ..... 347/40
5,907,338 A 5/1999 Burr et al.
6,260,963 B1 7/2001 Reistad et al.
6,692,109 B2 2/2004 Hirota et al.
6,719,404 B2 4/2004 Kobayashi
6,814,937 B1 * 11/2004 Hirota et al. ..... 422/100
6,830,325 B2 12/2004 Hirota et al.
2004/0257415 A1 12/2004 Arakawa et al.
2005/0073562 A1 * 4/2005 Taira ..... 347/93
2005/0116989 A1 * 6/2005 Chikamoto ..... 347/40

FOREIGN PATENT DOCUMENTS

JP H04-341853 A 11/1992
JP 2000177144 A 6/2000
JP 2000203017 A 7/2000
JP 20013196631 B2 6/2001
JP 2002052730 A 2/2002
JP 2003311951 A 11/2003
JP 2004306540 A 11/2004
JP H05-030921 Y2 9/2006

* cited by examiner

*Primary Examiner*—Stephen D Meier
*Assistant Examiner*—Carlos A Martinez, Jr.
(74) *Attorney, Agent, or Firm*—Baker Botts L.L.P.

(57) ABSTRACT

A cavity unit for use in an ink jet recording head, including plate members which stacked on each other and having an ink-introducing passage, a filter portion which removes foreign matters from introduced ink, two communication chambers which communicate with each other through the filter portion, and nozzles each of which ejects a droplet of the ink. The plate members include a filter plate including the filter portion, and a guide-passage plate which is provided adjacent the filter plate and which has, on an upstream side of an upstream-side one of the two communication chambers with respect to an ink-flow path, a guide passage which causes the introduced ink to flow, before the ink flows into the upstream-side communication chamber, in a direction along one surface of the filter plate.

19 Claims, 14 Drawing Sheets

CAVITY UNIT AND INK-JET RECORDING HEAD AND APPARATUS

The present application is based on Japanese Patent Applications No. 2005-256393 filed on Sep. 5, 2005 and No. 2005-265048 filed on Sep. 13, 2005, the contents of which are incorporated herein by reference.

BACKGROUND OF THE INVENTION

1. Field of the Invention

The present invention relates to an ink-jet recording apparatus or head, or a cavity unit for use in the apparatus or head.

2. Discussion of Related Art

There has been known an ink-jet recording apparatus or head employing a cavity unit including a plurality of plate members that are stacked on each other and that has at least one ink-introducing passage which introduces an ink, a plurality of nozzles each of which ejects a droplet of the ink, a plurality of pressure chambers (i.e., individual ink chambers) each of which outputs the ink to a corresponding one of the nozzles, and at least one ink manifold (i.e., common ink chamber) which temporarily stores the ink to be supplied to each of the pressure chambers. When a pressure is applied to an arbitrary one or ones of the pressure chambers, a corresponding one or ones of the nozzles ejects or eject a droplet or droplets of the ink toward a recording medium, so as to record an image thereon.

Generally, the ink-jet recording head further has, at an open end of an upstream-side end portion of the ink-introducing passage, a filter that removes foreign matters from the introduced ink. In addition, Patent Document 1 (Japanese Patent Application Publication 2004-306540 or its corresponding U.S. Patent Application Publication 2004-257415) discloses a cavity unit including (a) a filter and (b) a plate member that has a thickness greater than that of the filter, surrounds the filter, and defines a flat space between the filter and an ink-supply member located on an upstream side of the filter. Since ink flows at high speeds in the flat space, air bubbles can be easily removed from the filter, i.e., easily prevented from standing on the filter.

Moreover, Patent Document 2 (Japanese Patent Application Publication 2003-311951 or its corresponding U.S. Pat. Nos. 6,692,109, 6,719,404, and 6,830,325) discloses an ink-jet recording head in which a plate member provided on an upper side of an ink manifold (i.e., a common ink chamber) has, at a position corresponding to an ink-introducing passage, a multiplicity of small through-holes that are formed through a thickness of the plate member and cooperate with each other to function as a filter.

Each of the above-indicated two filters is originally designed such that even if the each filter may be clogged to some degree with an expected amount of foreign matters gradually accumulated thereon, the each filter can function normally for a certain time period.

SUMMARY OF THE INVENTION

However, since each of the above-indicated two filters is directly opposed to the ink-introducing passage, the ink introduced by the ink-introducing passage directly collides with the filter, and accordingly foreign matters present in the introduced ink are captured by, and accumulated on, the filter opposed to the ink-introducing passage. Therefore, the filter may be even entirely clogged with the foreign matters in a considerably short time, and accordingly the ink-introducing passage and the filter need to have respective excessively wide areas.

It is therefore an object of the present invention to solve at least one of the above-indicated problems. It is another object of the present invention to provide an ink-jet recording apparatus or head, or a cavity unit, that causes, before an ink flows into a filter portion, the ink to flow in a direction along a surface of the filter portion so that foreign matters present in the ink are accumulated on only a specific or local area of the filter portion and the ink is permitted to flow through a considerably large area of the filter portion. It is another object of the present invention to provide an ink-jet recording apparatus or head, or a cavity unit, that causes an ink to flow into an ink manifold in a direction from a lower side of a filter portion to an upper side of the same, so that foreign matters present in the ink are prevented from being accumulated on the filter portion and the ink is permitted to flow through a substantially entire area of the filter portion. It is another object of the present invention to provide an ink-jet recording apparatus or head, or a cavity unit, that enjoys a sufficiently long life expectation of a filter portion without needing to increase an area thereof.

The above objects may be achieved according to the present invention. According to the present invention, there is provided a cavity unit for use in an ink-jet recording head, comprising a plurality of plate members which are stacked on each other and which have at least one ink-introducing passage which introduces an ink, at least one filter portion which removes foreign matters from the introduced ink, at least one pair of communication chambers which are provided on either side of the at least one filter portion and communicate with each other through the at least one filter portion, and a plurality of nozzles each of which ejects a droplet of the ink, the plate members including a filter plate including, as at least one portion thereof, the at least one filter portion; and a guide-passage plate which is provided adjacent the filter plate and which has, on an upstream side of an upstream-side one of the at least one pair of communication chambers with respect to an ink-flow path along which the introduced ink flows from the at least one ink-introducing passage to the each nozzle, at least one guide passage which causes the introduced ink to flow, before the ink flows into the upstream-side communication chamber, in a first direction along one of opposite surfaces of the filter plate.

In the present cavity unit, the guide passage provided on the upstream side of the filter portion causes the introduced ink to flow, before the ink flows into the filter portion, in the direction along one surface of the filter plate. Thus, since the ink flows along one surface (e.g., an upper, lower, or vertical surface) of the filter portion, the flows of the ink sweep, on the surface of the filter portion, the foreign matters so that the foreign matters are not accumulated on all portions of the filter but only a specific or local portion thereof. That is, the filter portion can be prevented from being entirely clogged with the foreign matters and accordingly the cavity unit can enjoy a sufficiently long life expectation of the filter portion without needing to increase an area thereof. In a particular case where the guide passage causes the introduced ink to flow, before the ink flows into the filter portion, in the first direction along the lower surface of the filter portion, the ink flows from the upstream-side communication chamber into the downstream-side communication chamber in a direction from a lower side of the filter plate to an upper side thereof through the filter portion. Therefore, because of gravity, the foreign matters are caused to fall in a direction away from the filter portion, and are prevented from entering the filter portion. Thus, the filter portion is effectively prevented from being clogged with the foreign matters.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings. Each of the preferred embodiments relates to an ink-jet recording apparatus including a carriage (not shown) that is reciprocated along a recording sheet as a recording medium; and a piezoelectric-type ink-jet recording head 1 that is mounted on the carriage and ejects droplets of inks toward the recording sheet. However, the piezoelectric-type ink-jet recording head 1 may be replaced with a thermal-type ink-jet recording head that has individual heaters for thermally ejecting droplets of ink(s) from ink-ejection nozzles but does not have pressures chambers as individual ink chambers.

Figure 1:
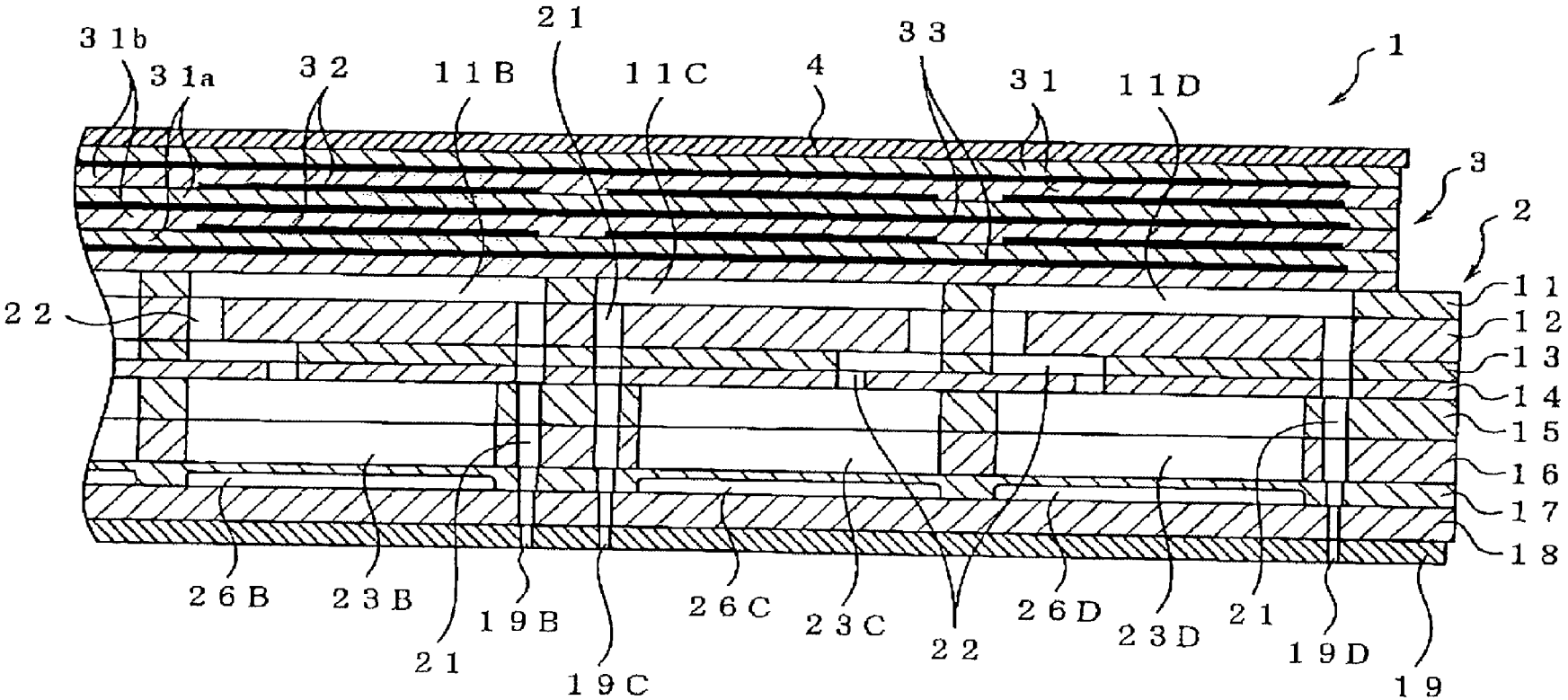
FIG. 1 is a cross-section view of a piezoelectric-type ink-jet recording head which is employed by an ink-jet recording apparatus and to which the present invention is applied.

In a first embodiment shown in FIG. 1, the ink-jet recording head 1 includes a cavity unit 2 that is constituted by a plurality of metal plates; a plate-type piezoelectric actuator 3 that is bonded to an upper surface of the cavity unit 2; and a flexible flat cable 4 that is bonded to an upper surface of the piezoelectric actuator 3, for connecting the piezoelectric actuator 3 to an external device (not shown).

As shown in FIG. 1, the cavity unit 2 is constituted by nine thin metal plates 11 through 19 that are stacked on each other and are bonded to each other with an adhesive. More specifically described, the nine metal plates 11 through 19 include, from top to bottom, a cavity plate 11 as an individual-ink-chamber plate; a base plate 12; an aperture plate 13 as a guide-passage plate; a filter plate 14; two manifold plates 15, 16 each as a common-ink-chamber plate; a damper plate 17 as a damper-chamber plate; a spacer plate 18; and a nozzle plate 19. The nozzle plate 19 has ink-ejection nozzles 19B, 19C, 19D which open in a lower surface thereof and from which the cavity unit 2 ejects droplets of inks in a downward direction. Each of the plate members 11 through 19 is formed of a 42%-nickel-alloy-steel plate having a thickness of from 50 μm to 150 μm.

Figure 2:
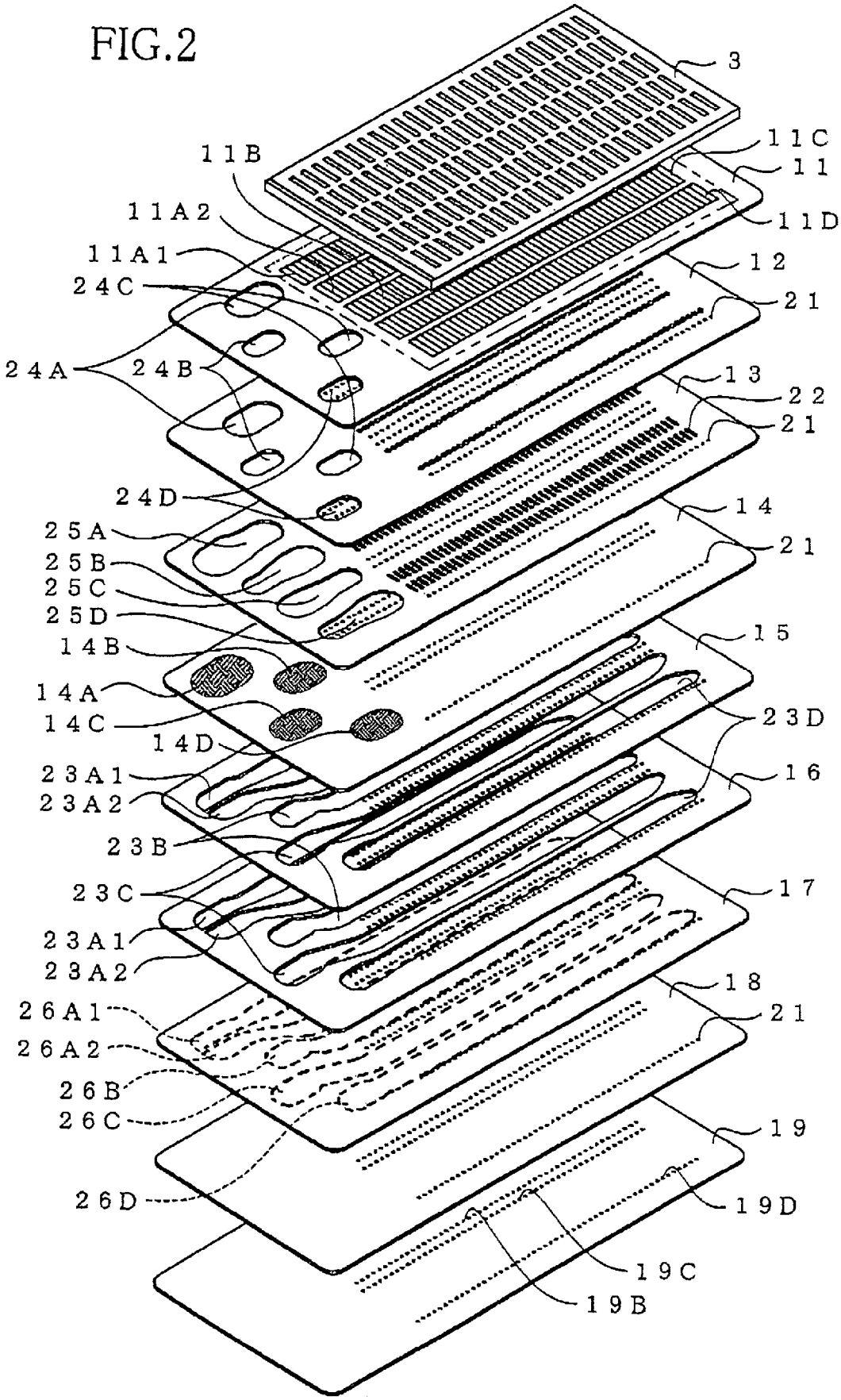
FIG. 2 is an exploded, perspective view of the ink-jet recording head.

As shown in FIG. 2, the cavity plate 11 has a plurality of pressure chambers 11A1, 11A2, 11B, 11C, 11D each as an individual ink chamber. Each of the pressure chambers 11A1, 11A2, 11B, 11C, 11D is provided as a through-hole formed through a thickness of the cavity plate 11, and is, in its plan view, elongate in a widthwise direction of the same 11 (i.e., leftward and rightward directions in FIG. 1). Two arrays of pressure chambers 11A1, 11A2 correspond to a black ink; and three arrays of pressure chambers 11B, 11C, 11D correspond to a cyan ink, a yellow ink, and a magenta ink, respectively. Thus, the pressure chambers 11A1, 11A2, 11B, 11C, 11D are arranged, in their plan view, in five arrays in a staggered or zigzag fashion in a lengthwise direction of the cavity plate 11 (i.e., a direction perpendicular to the drawing sheet of FIG. 1). When an arbitrary one or ones of the pressure chambers 11A1, 11A2, 11B, 11C, 11D is or are pressed by the piezoelectric actuator 3 provided on the cavity plate 11, the corresponding ink-ejection nozzle or nozzles 19B, 19C, 19D ejects or eject a droplet or droplets of the ink(s). The two arrays of ink-ejection nozzles corresponding to the two arrays of pressure chambers 11A1, 11A2 are not shown in the drawings.

One of lengthwise opposite end portions of each of the pressure chambers 11A1, 11A2, 11B, 11C, 11D communicates with a corresponding one of the ink-ejection nozzles 19B, 19C, 19D via a connection passage 21 that is provided as a group of through-holes formed through respective thickness of the seven plate members 12, 13, 14, 15, 16, 17, 18 provided between the cavity plate 11 and the nozzle plate 19.

On the other hand, the other end portion of each of the pressure chambers 11A1, 11A2, 11B, 11C, 11D communicates with a corresponding one of five ink manifolds 23A1, 23A2, 23B, 23C, 23D each as a common ink chamber via a restrictor passage 22 that is provided as a group of through-holes formed through respective thickness of the three plate members 12, 13, 14 provided between the cavity plate 11 and the upper manifold plate 15. A transverse-cross-section area of each of the restrictor passages 22 is made so small as to resist the flow of a corresponding one of the four inks from a corresponding one of the five ink manifolds 23A1, 23A2, 23B, 23C, 23D to a corresponding one of the pressure chambers 11A1, 11A2, 11B, 11C, 11D.

The two manifold plates 15, 16 cooperate with each other to define the five ink manifolds 23A1, 23A2, 23B, 23C, 23D which are elongate, in a lengthwise direction of the plates 15, 16, along the five arrays of ink-ejection nozzles 19B, 19C, 19D, respectively, and each of which is formed through respective thickness of the two manifold plates 15, 16. More specifically described, as shown in FIG. 1, the two manifold plates 15, 16 are stacked on each other, the filter plate 14 is stacked on an upper surface of the upper manifold plate 15, and the damper plate 17 is provided under a lower surface of the lower manifold plate 16. Thus, the five ink manifolds 23A1, 23A2, 23B, 23C, 23D are defined or formed independent of each other. Each of the five ink manifolds 23A1, 23A2, 23B, 23C, 23D is elongate along a corresponding one of the five arrays of pressure chambers 11A1, 11A2, 11B, 11C, 11D, and overlaps, in a plan view thereof in the direction of stacking of the plate members 11 through 19, each of the pressure chambers of the corresponding array 11A1, 11A2, 11B, 11C, 11D. The two ink manifolds 23A1, 23A2 correspond to the black ink; and the three ink manifolds 23B, 23C, 23D correspond to the cyan ink, the yellow ink, and the magenta ink, respectively.

The damper plate 17 has five damper chambers 26A1, 26A2, 26B, 26C, 26D that are provided as recesses formed in a lower surface thereof such that the five damper chambers 26A1, 26A2, 26B, 26C, 26D correspond to the five ink manifolds 23A1, 23A2, 23B, 23C, 23D, respectively. The damper plate 17 has five diaphragms each as an elastic portion that are provided between the five ink manifolds 23A1, 23A2, 23B, 23C, 23D and the five damper chambers 26A1, 26A2, 26B, 26C, 26D, respectively, and each of which is elastically flexible or deformable into a corresponding one of the five ink manifolds 23A1, 23A2, 23B, 23C, 23D and a corresponding one of the five damper chambers 26A1, 26A2, 26B, 26C, 26D.

As shown in FIG. 2, the plurality of ink-ejection nozzles 19B, 19C, 19D are formed through a thickness of the nozzle plate 19, and are arranged in the five arrays such that in each array, the nozzles are provided at a regular small interval in the lengthwise direction of the nozzle plate 19 (i.e., the direction perpendicular to the drawing sheet of FIG. 1). Each of the ink-ejection nozzles 19B, 19C, 19D has a diameter of about 25 μm.

The plate-type piezoelectric actuator 3 is the same as disclosed by, e.g., Japanese Patent Application Publication No. 4-341853. More specifically described, the piezoelectric actuator 3 includes a plurality of piezoelectric sheets 31 which are stacked on each other and each of which has a thickness of about 30 μm. On an upper, major surface of every second one 31*a* of the piezoelectric sheets 31, counted from bottom, except for the top piezoelectric sheet 31, there are provided five arrays of elongate individual electrodes 32 at respective positions corresponding to the five arrays of pressure chambers 11A1, 11A2, 11B, 11C, 11D, such that the five arrays of individual electrodes 32 extend in a widthwise direction of the piezoelectric sheets 31*a*. In addition, on an upper, major surface of the other piezoelectric sheets 31*b*, there are provided a common electrode 33 that is common to, and is opposed to, all the pressure chambers 11A1, 11A2, 11B, 11C, 11D.

An adhesive sheet (not shown) that is formed of a synthetic resin resistant to permeation of ink is applied, in advance, to an entire lower surface of the piezoelectric actuator 3 that is to be bonded to the cavity unit 2 or the cavity plate 11. Subsequently, the piezoelectric actuator 3 is fixed, by adhesion, to the cavity unit 2 such that the five arrays of individual electrodes 32, provided on each of the piezoelectric sheets 31*a*, correspond to the five arrays of pressure chambers 11A1, 11A2, 11B, 11C, 11D, respectively. The flexible flat cable 4 has a plurality of individual wires corresponding to the individual electrodes 32, respectively, and at least one common wire corresponding to the common electrodes 33, and is fixed to the upper surface of the piezoelectric actuator 3 such that those wires are connected to the individual electrodes 32 and the common electrodes 33.

Figure 3:
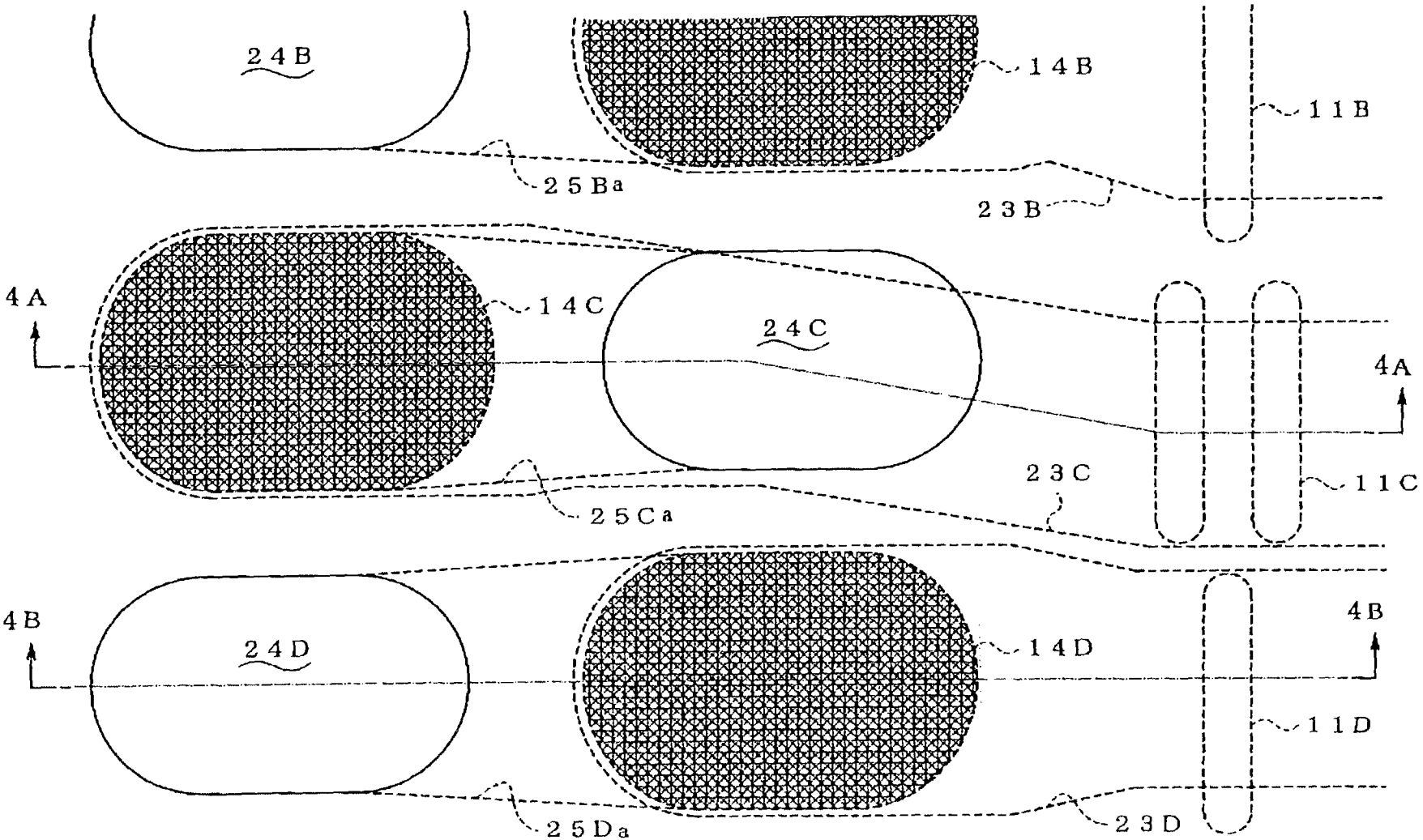
FIG. 3 is a plan view of a portion of a cavity unit of the ink-jet recording head that is around a plurality of ink-introducing passages.

As shown in FIGS. 2, 3, and 4, one of lengthwise opposite end portions of each of the five ink manifolds 23A1, 23A2, 23B, 23C, 23D communicates with a corresponding one of four ink-supply sources (not shown) via a corresponding one of four ink-introducing passages 24A, 24B, 24C, 24D, and a corresponding one of four communication passages 25A, 25B, 25C, 25D. A downstream-side end portion of each of the four communication passages 25A, 25B, 25C, 25D with respect to a direction of flow of a corresponding one of the four inks communicates with a corresponding one or two of the five ink manifolds 23A1, 23A2, 23B, 23C, 23D via a corresponding one of four filter portions 14A, 14B, 14C, 14D that removes foreign matters present in the corresponding ink. The flow of the black ink is bifurcated, at the filter portion 14A, into two flows corresponding to the two ink manifolds 23A1, 23A2.

Figure 4A:
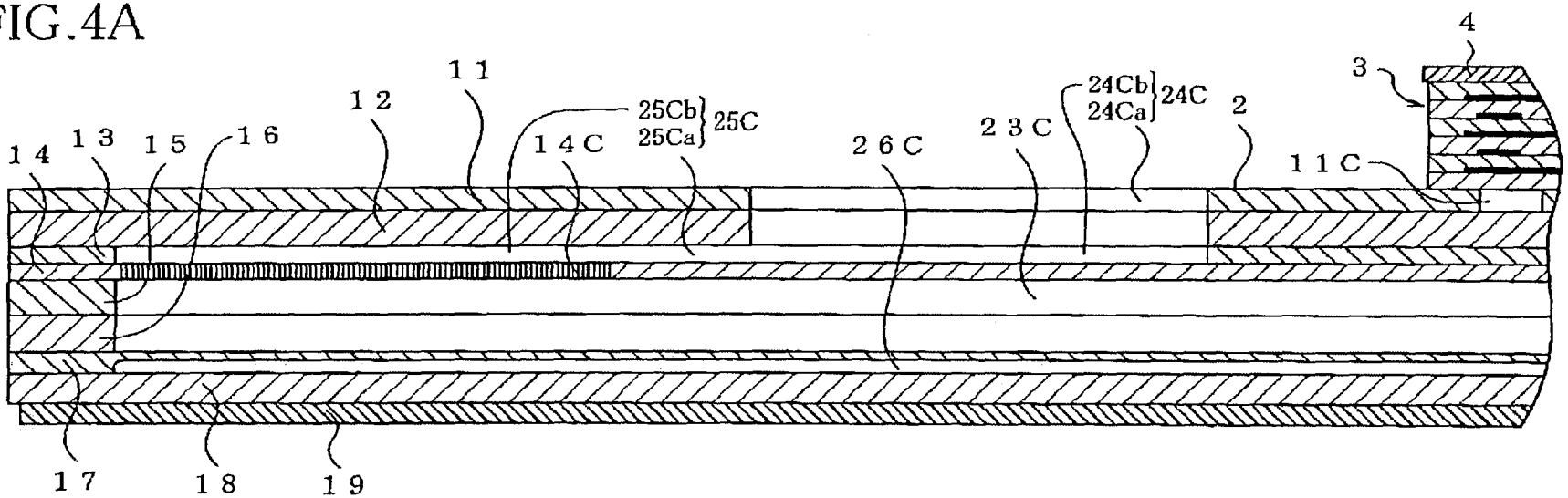
FIG. 4A is a cross-section view of the cavity unit, taken along 4A-4A in FIG. 3.
Figure 4B:
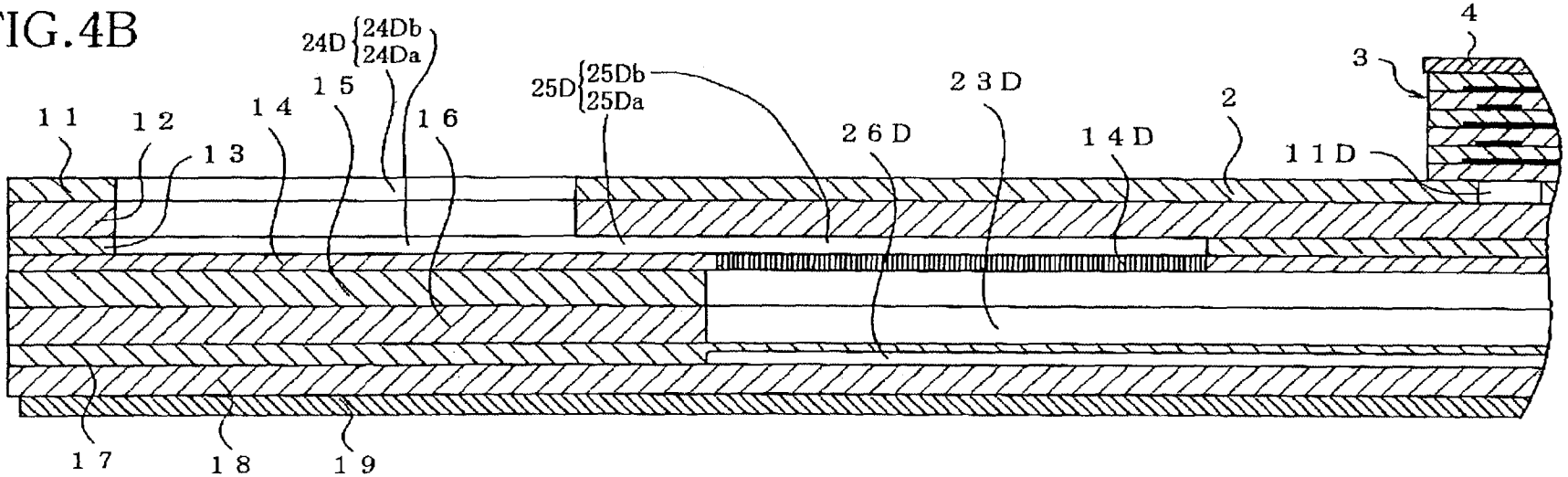
FIG. 4B is another cross-section view of the cavity unit, taken along 4B-4B in FIG. 3.

Each of the four ink-introducing passages 24A, 24B, 24C, 24D is provided as a group of through-holes formed through respective thickness of the cavity plate 11, the base plate 12, and the aperture plate 13; and each of the four communication passages 25A, 25B, 25C, 25D is provided as a through-hole formed through a thickness of the aperture plate 13. An upstream-side end portion of each of the four communication passages 25A, 25B, 25C, 25D communicates with a downstream-side end portion of a corresponding one of the four ink-introducing passages 24A, 24B, 24C, 24D, and the downstream-side end portion of each of the four communication passage 25A, 25B, 25C, 25D communicates with a corresponding one of the four filter portions 14A, 14B, 14C, 14D. Thus, for each of the four inks, a corresponding one of the four ink-introducing passages 24A, 24B, 24C, 24D and a corresponding one of the four communication passage 25A, 25B, 25C, 25D communicates with a corresponding one or two of the five ink manifolds 23A1, 23A2, 23B, 23C, 23D via a corresponding one of the four filter portions 14A, 14B, 14C, 14D. A transverse cross-section area (i.e., ink-flow cross-section area) of each of the four communication passages 25A, 25B, 25C, 25D increases in the direction of flow of the corresponding ink therethrough. As shown in FIGS. 3, 4A, and 4B, each of the four communication passage 25A, 25B, 25C, 25D includes a guide passage 25Ba, 25Ca, 25Da and a communication chamber 25Cb, 25Db. The guide passage of the communication passage 25A and the respective communication chambers of the two communication passages 25A, 25B are not shown in FIGS. 3, 4A, and 4B.

As shown in FIG. 2, the four filter portions 14A, 14B, 14C, 14D are provided as respective portions of the filter plate 14 that is stacked on the upper surface of the upper manifold plate 15, such that the four filter portions 14A, 14B, 14C, 14D correspond to respective one end portions of the five ink manifolds 23A1, 23A2, 23B, 23C, 23D. Each of the filter portions 14A, 14B, 14C, 14D may be provided in any of the following manners: (i) a multiplicity of small holes are formed through a thickness of an appropriate portion of the filter plate 14, (ii) a filter member is fitted in a large hole formed through a thickness of an appropriate portion of the filter plate 14, and (iii) the filter plate 14 is obtained by bonding a first plate member having a multiplicity of small holes formed through a thickness thereof and over an entire area thereof, and a second plate member having a large hole formed through a thickness of an appropriate portion thereof, to each other. The filter portion 14A corresponding to the black ink is common to the two ink manifolds 23A1, 23A2; and the three filter portions 14B, 14C, 14D correspond to the three manifolds 23B, 23C, 23D, respectively. Each of the five ink manifolds 23A1, 23A2, 23B, 23C, 23D each as the common ink chamber provides a communication chamber that communicates with a corresponding one of the respective communication chambers 25Cb, 25Cb of the four communication passages 25A, 25B, 25C, 25D via a corresponding one of the four filter portions 14A, 14B, 14C, 14D.

Each of the four ink-introducing passages 24A, 24B, 24C, 24D is for causing a corresponding one of the four inks respectively supplied from the four ink-supply sources (not shown), to flow in the direction of stacking of the plate members 11 through 19, and is provided at a position distant from a corresponding one of the four filter portions 14A, 14B, 14C, 14D in the direction of flow of the corresponding ink through a corresponding one of the four guide passages 25Ba, 25Ca, 25Da. That is, each of the four ink-introducing passages 24A, 24B, 24C, 24D is opposed to a solid portion of the filter plate 14 that is free of a corresponding one of the filter portions 14A, 14B, 14C, 14D, and accordingly the ink flowing in the each ink-introducing passage 24A, 24B, 24C, 24D is deflected by the filter plate 14 so as to flow into a corresponding of the four guide passages 25Ba, 25Ca, 25Da. Thus, before the ink enters the corresponding filter portion 14A, 14B, 14C, 14D, the ink is guided by the corresponding guide passage 25Ba, 25Ca, 25Da so as to flow in a direction along the upper surface of the filter plate 14.

As shown in FIG. 3, the four ink-introducing passages 24A, 24B, 24C, 24D are arranged, in their plan view, in a staggered or zigzag fashion. That is, each pair of adjacent ink-introducing passages 24A and 24B, or 24B and 24C, or 24C and 24D that are adjacent to each other in the widthwise direction of the cavity unit 2 are off-set from each other in the lengthwise direction of the same 2, and do not overlap each other as seen in the widthwise direction of the same 2. The four filter portion 14A, 14B, 14C, 14D are also arranged in a staggered fashion so as to correspond to the four ink-introducing passages 24A, 24B, 24C, 24D, respectively, but are alternate with the four ink-introducing passages 24A, 24B, 24C, 24D in the widthwise direction of the cavity unit 2. That is, each pair of adjacent filter portions 14A and 14B, or 14B and 14C, or 14C and 14D that are adjacent to each other in the widthwise direction of the cavity unit 2 are off-set from each other in the lengthwise direction of the same 2, more strictly, in the direction opposite to the direction in which each pair of adjacent ink-introducing passages 24A and 24B, or 24B and 24C, or 24C and 24D are off-set from each other, and do not overlap each other as seen in the widthwise direction of the same 2.

As shown in FIG. 3, a width of each of the filter portions 14A, 14B, 14C, 14D in the widthwise direction of the cavity unit 2 is greater than a width of a corresponding one of the ink-introducing passages 24A, 24B, 24C, 24D. Accordingly, each of the guide passage 25A, 25B, 25C, 25D is formed such that a width thereof increases in a direction from a corresponding one of the ink-introducing passages 24A, 243, 24C, 24D toward a corresponding one of the filter portions 14A, 14B, 14C, 14D. Thus, even though the width of the cavity unit 2 may be small, the filter portions 14A, 14B, 14C, 14D can each enjoy an increased area because the filter portions 14A, 14B, 14C, 14D and the corresponding ink-introducing passages 24A, 24B, 24C, 24D are off-set from each other in the lengthwise direction of the cavity unit 2 and are alternate with each other in the widthwise direction of the same 2. In addition, since the ink-introducing passages 24A, 24B, 24C, 24D can be arranged at an increased regular interval of distance in the widthwise direction of the cavity unit 2, respective supply members (not shown) that extended from the four ink-supply sources can be connected to the four ink-introducing passages 24A, 24B, 24C, 24D each with a highly reliable liquid-tight sealing.

The ink-jet recording head 1 has a plurality of ink-flow paths or channels that start with the ink-introducing passages 24A, 24B, 24C, 24D and end with the ink-ejection nozzles 19B, 19C. 19D. First, each of the four inks flows from a corresponding one of the four ink-introducing passages 24A, 24B, 24C, 24D to a corresponding one or two of the five ink manifolds 23A1, 23A2, 23B, 23C, 23D. As shown in FIGS. 4A and 4B, since each of the ink-introducing passages 24A, 24B, 24C, 24D is so formed as to cause the corresponding ink to flow in the direction of stacking of the plate members 11 through 19, the ink collides with the filter plate 14 when the ink enters from an upstream-side portion 24Ca, 24Da of the each ink-introducing passage 24A, 24B, 24C, 24D into a downstream-side end portion 24Cb, 24Db thereof. Consequently the direction of flowing of the ink is changed from the vertically downward direction to the horizontal direction. That is, the filter plate 14 functions as an obstacle plate or an ink-flow changing member that not only changes the direction of flowing of each ink but also lowers the velocity of flowing of the same. In addition, since the transverse-cross-section area of each of the four guide passages 25Ba, 25Ca, 25Da gradually increases in the direction from the upstream-side end thereof toward the downstream-side end thereof, the each guide passage 25Ba, 25Ca, 25Da contributes to lowering the velocity of flowing of the corresponding ink.

In addition, before each of the four inks flows into a corresponding one of the four filter portions 14, 14B, 14C, 14D, a corresponding one of the four guide passages 25Ba, 25Ca, 25Da located on the upstream side of a corresponding one of the four communication chambers 25Cb, 25Db and a corresponding one of the four filter portions 14A, 14B, 14C, 14D causes the ink to flow in the direction along the upper surface of the filter plate 14, so that the flow of the ink sweeps the foreign matters away from an upper surface of the corresponding filter portion 14A, 14B, 14C, 14D (i.e., from respective upper open ends of the small holes of the filter portion). Consequently the foreign matters are accumulated in the respective downstream-side end portions of the four communication chambers 25Cb, 25Db. In contrast, in a generally known, conventional ink-jet recording head wherein ink flows into a filter portion in a direction perpendicular to an upper surface thereof, foreign matters are accumulated on the entire upper surface of the filter portion. That is, in the present ink-jet recording head 1, foreign matters such as dust are accumulated on only a specific or local, small portion or area of the upper surface of each of the filter portions 14A, 14B, 14C, 14D, and accordingly a large portion or area of the each filter portion 14A, 14B, 14C, 14D that is near to the corresponding guide passage 25Ba, 25Ca, 25Da is prevented from being clogged with the foreign matters. Thus, each of the filter portions 14A, 14B, 14C, 14D can normally function as a portion of the corresponding ink-flow path for an increased time duration.

Then, each of the four inks is supplied from the corresponding ink manifold or manifolds 23A1, 23A2, 23B, 23C, 23D to the pressure chambers of the corresponding array or arrays 11A1, 11A2, 11B, 11C, 11D via the corresponding restrictor passages 22. When the piezoelectric actuator 3 is driven or operated, the droplet(s) of the each ink is(are)

ejected from the pressure chamber(s) of the corresponding array(s) 11A1, 11A2, 11B, 11C, 11D via the corresponding connection passage(s) 21 and the corresponding nozzle(s) 19B, 19C, 19D.

While the present invention has been described in its preferred embodiment, it is to be understood that the present invention may be otherwise embodied.

For example, in the illustrated embodiment, the transverse-cross-section area of each of the four guide passages 25Ba, 25Ca, 25Da gradually increases in the direction from the upstream-side end thereof toward the downstream-side end thereof. However, in a modified form of the illustrated embodiment, the ink-introducing passages 24A, 243, 24C, 24D are formed such that the transverse-cross-section area of each of the ink-introducing passages 24A, 243, 24C, 24D gradually increases in the direction from the upstream-side end thereof toward the downstream-side end thereof. The modified form enjoys the same advantages as those of the illustrated embodiment. In another modified form of the illustrated embodiment, the transverse-cross-section area of each of the four guide passages 25Ba, 25Ca, 25Da gradually increases in the direction from the upstream-side end thereof toward the downstream-side end thereof and the transverse-cross-section area of each of the ink-introducing passages 24A, 24B, 24C, 24D gradually increases in the direction from the upstream-side end thereof toward the downstream-side end thereof.

Figure 5:
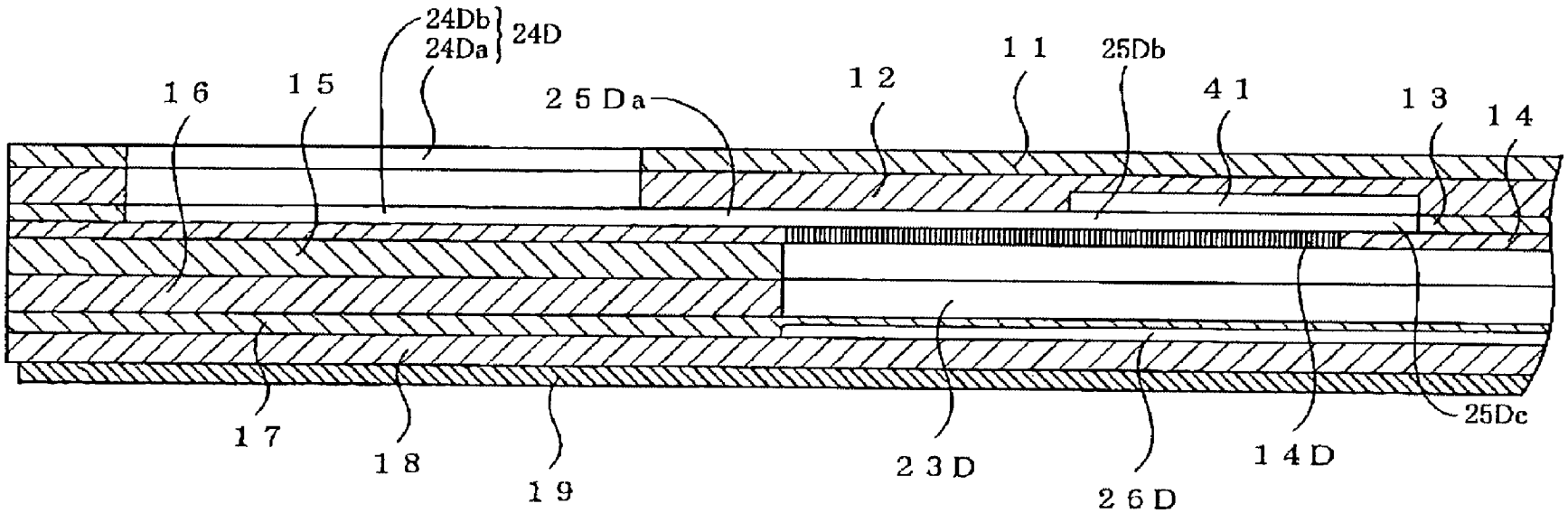
FIG. 5 is a cross-section view corresponding to FIG. 4B, and showing another cavity unit of another ink-jet recording head as a second embodiment of the present invention.

In addition, in the illustrated embodiment, each of the four guide passages 25B, 25C, 25D only causes the corresponding ink to flow in the direction along the upper surface of the filter plate 14 and flows into the corresponding filter portion 14A, 14B, 14C, 14D via the corresponding communication chamber 25Cb, 25Db. However, in a second embodiment shown in FIG. 5, each of the four guide passages 25Da communicates, via the corresponding communication chamber 25Db, with a foreign-matter trapping portion 25Dc that can trap or collect a large amount of foreign matters. In addition, the base plate 12 as a trapping plate has, in each of respective portions of the lower surface thereof that are opposed to the four filter portions 14A, 14B, 14C, 14D, a foreign-matter trapping portion 41 that is provided in the form of a recess and that can trap or collect a larger amount of foreign matters. The foreign-matter trapping portion 41 includes an extended portion that is opposed to the foreign-matter trapping portion 25Dc. However, the foreign-matter trapping portion 41 may be omitted, or alternatively the foreign-matter trapping portion 25Dc and the extended portion of the foreign-matter trapping portion 41 may be omitted.

Figure 6A:
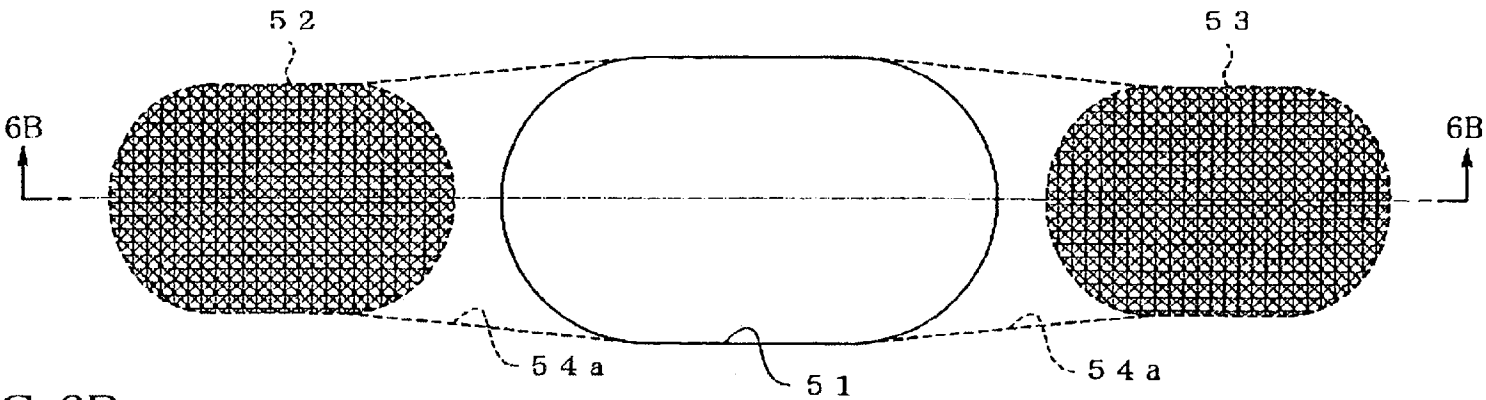
FIG. 6A is a plan view corresponding to FIG. 3, and showing an ink-introducing passage of another cavity unit of another ink-jet recording head as a third embodiment of the present invention.
Figure 6B:
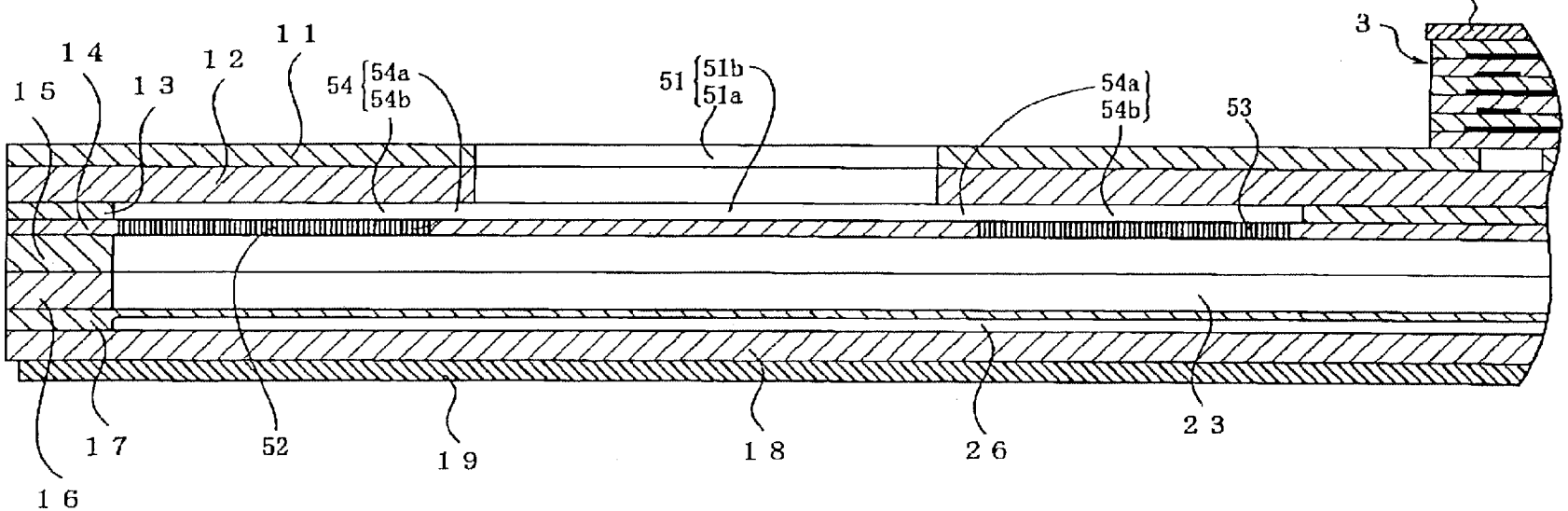
FIG. 6B is a cross-section view corresponding to FIGS. 4A and 4B, and showing the cavity unit taken along 6B-6B in FIG. 6A.

In addition, in the illustrated embodiment, the four ink-introducing passages 24A, 24B, 24C, 24D correspond, one to one, to the four filter portions 14A, 14B, 14C, 14D. However, in a third embodiment shown in FIGS. 6A and 6B, an ink-introducing passage 51 corresponding to each of the ink-introducing passages 24A, 24B, 24C, 24D shown in FIG. 1 communicates with two filter portions 52, 53 each corresponding to the filter portions 14A, 14B, 14C, 14D shown in FIG. 1, such that the two filter portions 52, 53 are distant from the ink-introducing passage 51 in opposite directions, respectively, that are perpendicular to the direction of flowing of ink in the ink-introducing passage 51. A downstream-side end portion 51*b* of the ink-introducing passage 51 communicates with the two filter portions 52, 53 via respective communication passages 54 that include respective guide passages 54*a* and respective communication chambers 54*b* and that extend in the above-indicated opposite directions, respectively. In the third embodiment, since the two filter portions 52, 53 communicate with the single ink-introducing passage 51, a width and/or an area of each one of the filter portions 52, 53 can be reduced while a sum of respective ink-flow cross-section areas of the same 52, 53 remains comparable to that of each of the filter portions 14A, 14B, 14C, 14D.

Hereinafter, there will be described a fourth embodiment of the present invention by reference to FIGS. 7 through 10. The fourth embodiment relates to an ink-jet recording apparatus including a carriage (not shown) that is reciprocated along a recording sheet as a recording medium; and a piezoelectric-type ink-jet recording head 101 that is mounted on the carriage and ejects droplets of inks toward the recording sheet.

Figure 7:
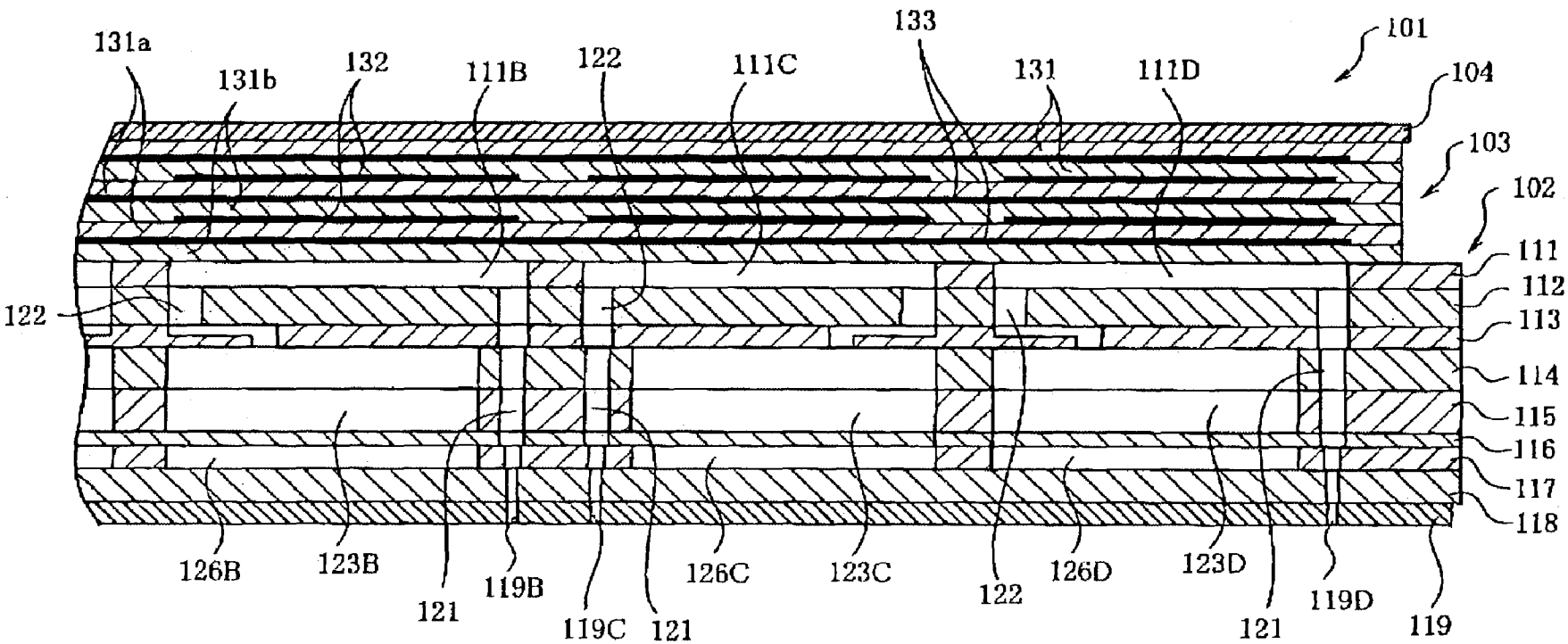
FIG. 7 is a cross-section view corresponding to FIG. 1, and showing another piezoelectric-type ink-jet recording head as a fourth embodiment of the present invention.

As shown in FIG. 7, the ink-jet recording head 101 includes a cavity unit 102 that is constituted by a plurality of metal plates; a plate-type piezoelectric actuator 103 that is bonded to an upper surface of the cavity unit 102; and a flexible flat cable 104 that is bonded to an upper surface of the piezoelectric actuator 103, for connecting the piezoelectric actuator 103 to an external device (not shown).

As shown in FIG. 7, the cavity unit 102 is constituted by nine thin metal plates 111 through 119 that are stacked on each other and are bonded to each other with an adhesive. More specifically described, the nine metal plates 111 through 119 include, from top to bottom, a cavity plate 111 as an individual-ink-chamber plate member; a base plate 112; an aperture plate 113; two manifold plates 114, 115 each as a common-ink-chamber plate; a filter plate 116; a damper plate 117 as a guide-passage plate or a damper-chamber plate; a spacer plate 118; and a nozzle plate 119. The nozzle plate 119 has ink-ejection nozzles 119B, 119C, 119D which open in a lower surface thereof and from which the cavity unit 102 ejects droplets of inks in a downward direction. Each of the plate members 111 through 119 is formed of a 42%-nickel-alloy-steel plate having a thickness of from 50 μm to 150 μm.

Figure 8:
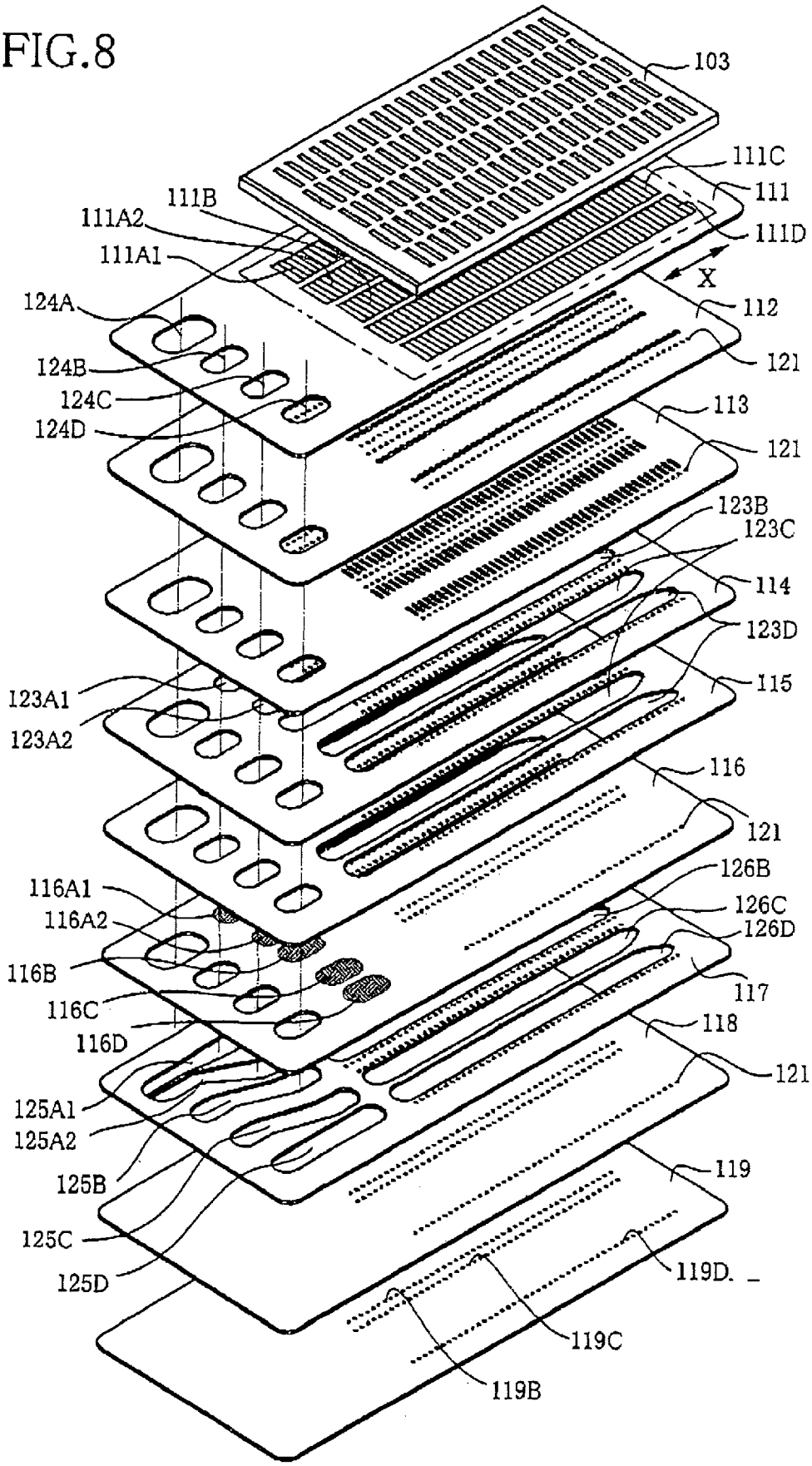
FIG. 8 is an exploded, perspective view corresponding to FIG. 2, and showing the ink-jet recording head of FIG. 7.

As shown in FIG. 8, the cavity plate 111 has a plurality of pressure chambers 111A1, 111A2, 111B, 111C, 111D each as an individual ink chamber. Each of the pressure chambers 111A1, 111A2, 111B, 111C, 111D is provided as a through-hole formed through a thickness of the cavity plate 111, and is, in its plan view, elongate in a widthwise direction thereof (i.e., leftward and rightward directions in FIG. 7). Two arrays of pressure chambers 111A1, 111A2 correspond to a black ink; and three arrays of pressure chambers 111B, 111C, 111D correspond to a cyan ink, a yellow ink, and a magenta ink, respectively. Thus, the pressure chambers 111A1, 111A2, 111B, 111C, 111D are arranged, in their plan view, in five arrays in a staggered or zigzag fashion in a lengthwise direction of the cavity plate 111 (i.e., a direction perpendicular to the drawing sheet of FIG. 7). When the pressure chambers 111A1, 111A2, 111B, 111C, 111D are pressed by the piezoelectric actuator 3 provided on the cavity plate 11, the corresponding ink-ejection nozzles 19B, 19C, 19D eject droplets of the inks. The two arrays of nozzles corresponding to the two arrays of pressure chambers 111A1, 111A2 are not shown in the drawings.

One of lengthwise opposite end portions of each of the pressure chambers 111A1, 111A2, 111B, 111C, 111D communicates with a corresponding one of the ink-ejection nozzles 119B, 119C, 119D via a connection passage 121 that is provided as a group of through-holes formed through respective thickness of the seven plate members 112, 113, 114, 115, 116, 117, 118 provided between the cavity plate 111 and the nozzle plate 119.

On the other hand, the other end portion of each of the pressure chambers 111A1, 111A2, 111B, 111C, 111D communicates with a corresponding one of five ink manifolds 123A1, 123A2, 123B, 123C, 123D each as a common ink chamber via a restrictor passage 122 that is provided as a group of through-holes formed through respective thickness of the two plate members 112, 113 provided between the cavity plate 111 and the upper manifold plate 114. A transverse-cross-section area of each of the restrictor passages 122 is made so small as to resist the flow of a corresponding one of the four inks from a corresponding one of the five ink manifolds 123A1, 123A2, 123B, 123C, 123D to a corresponding one of the pressure chambers 111A1, 111A2, 111B, 111C, 111D.

The two manifold plates 114, 115 cooperate with each other to define the five ink manifolds 123A1, 123A2, 123B, 123C, 123D which are elongate, in a lengthwise direction of the plates 114, 115, along the five arrays of ink-ejection nozzles 119B, 119C, 119D, respectively, and each of which is formed through respective thickness of the two manifold plates 114, 115. More specifically described, as shown in FIG. 7, the two manifold plates 114, 115 are stacked on each other, the aperture plate 113 is stacked on an upper surface of the upper manifold plate 114, and the filter plate 116 is provided under a lower surface of the lower manifold plate 115. Thus, the five ink manifolds 123A1, 123A, 123B, 123C, 123D are defined or formed independent of each other. Each of the five ink manifolds 123A1, 123A2, 123B, 123C, 123D is elongate along a corresponding one of the five arrays of pressure chambers 111A1, 111A2, 111B, 111C, 111D, and overlaps, in a plan view thereof in the direction of stacking of the plate members 111 through 119, each of the pressure chambers of the corresponding array 111A1, 111A2, 111B, 111C, 111D. The two ink manifolds 123A1, 123A2 correspond to the black ink; and the three ink manifolds 123B, 123C, 123D correspond to the cyan ink, the yellow ink, and the magenta ink, respectively.

The damper plate 117 has five damper chambers 126B, 126C, 126D that are provided as through-holes formed through a thickness thereof such that the five damper chambers 126B, 126C, 126D correspond to the five ink manifolds 123A1, 123A2, 123B, 123C, 123D, respectively. The two damper chambers corresponding to the two ink manifolds 123A1, 123A2 are not shown in the drawings. The filter plate 116 sandwiched by the lower manifold plate 115 and the damper plate 117 has five diaphragms each as an elastic portion that are provided between the five ink manifolds 123A1, 123A2, 123B, 123C, 123D and the five damper chambers 126B, 126C, 126D, respectively, and each of which is elastically flexible or deformable into a corresponding one of the five ink manifolds 123A1, 123A2, 123B, 123C, 123D and a corresponding one of the five damper chambers 126B, 126C, 126D. Thus, when a droplet of ink is ejected from one of the pressure chambers 111A1, 111A2, 111B, 111C, 111D via a corresponding one of the ink-ejection nozzles 119B, 119C, 119D, a pressure wave of the ink, transmitted backward to the corresponding ink manifold 123A1, 123A2, 123B, 123C, 123D, can be absorbed by the elastic deformation of the filter plate 16, and can be prevented from being transmitted to the other pressure chambers and thereby adversely influencing the ejection of the inks. Thus, the phenomenon of so-called "cross-talk" can be effectively prevented.

As shown in FIG. 8, the plurality of ink-ejection nozzles 119B, 119C, 119D are formed through a thickness of the nozzle plate 119, and are arranged in the five arrays such that in each array, the nozzles are provided at a regular small interval in the lengthwise direction of the nozzle plate 119 (i.e., the direction perpendicular to the drawing sheet of FIG. 7). Each of the nozzles 119B, 119C, 119D has a diameter of about 25 μm.

The plate-type piezoelectric actuator 103 is the same as the piezoelectric actuator 3 employed in the first embodiment. The piezoelectric actuator 103 includes a plurality of piezoelectric sheets 131 which are stacked on each other and each of which has a thickness of about 30 μm. On an upper, major surface of every second one 131*a* of the piezoelectric sheets 131, counted from bottom, except for the top piezoelectric sheet 131, there are provided five arrays of elongate individual electrodes 132 at respective positions corresponding to the five arrays of pressure chambers 111A1, 111A2, 111B, 111C, 111D, such that the five arrays of individual electrodes 132 extend in a widthwise direction of the piezoelectric sheets 131*a*. In addition, on an upper, major surface of each of the other piezoelectric sheets 131*b*, there is provided a common electrode 133 that is common to, and is opposed to, all the pressure chambers 111A1, 111A2, 111B, 111C, 111D.

An adhesive sheet (not shown) that is formed of a synthetic resin resistant to permeation of ink is applied, in advance, to an entire lower surface of the piezoelectric actuator 103 that is to be bonded to the cavity unit 102 or the cavity plate 111. Subsequently the piezoelectric actuator 103 is fixed, by adhesion, to the cavity unit 102 such that the five arrays of individual electrodes 132, provided on each of the piezoelectric sheets 131*a*, correspond to the five arrays of pressure chambers 111A1, 111A2, 111B, 111C, 111D, respectively. The flexible flat cable 104 has a plurality of individual wires corresponding to the individual electrodes 132, respectively, and at least one common wire corresponding to the common electrodes 133, and is fixed to the upper surface of the piezoelectric actuator 103 such that those wires are connected to the individual electrodes 132 and the common electrodes 133.

Figure 9:
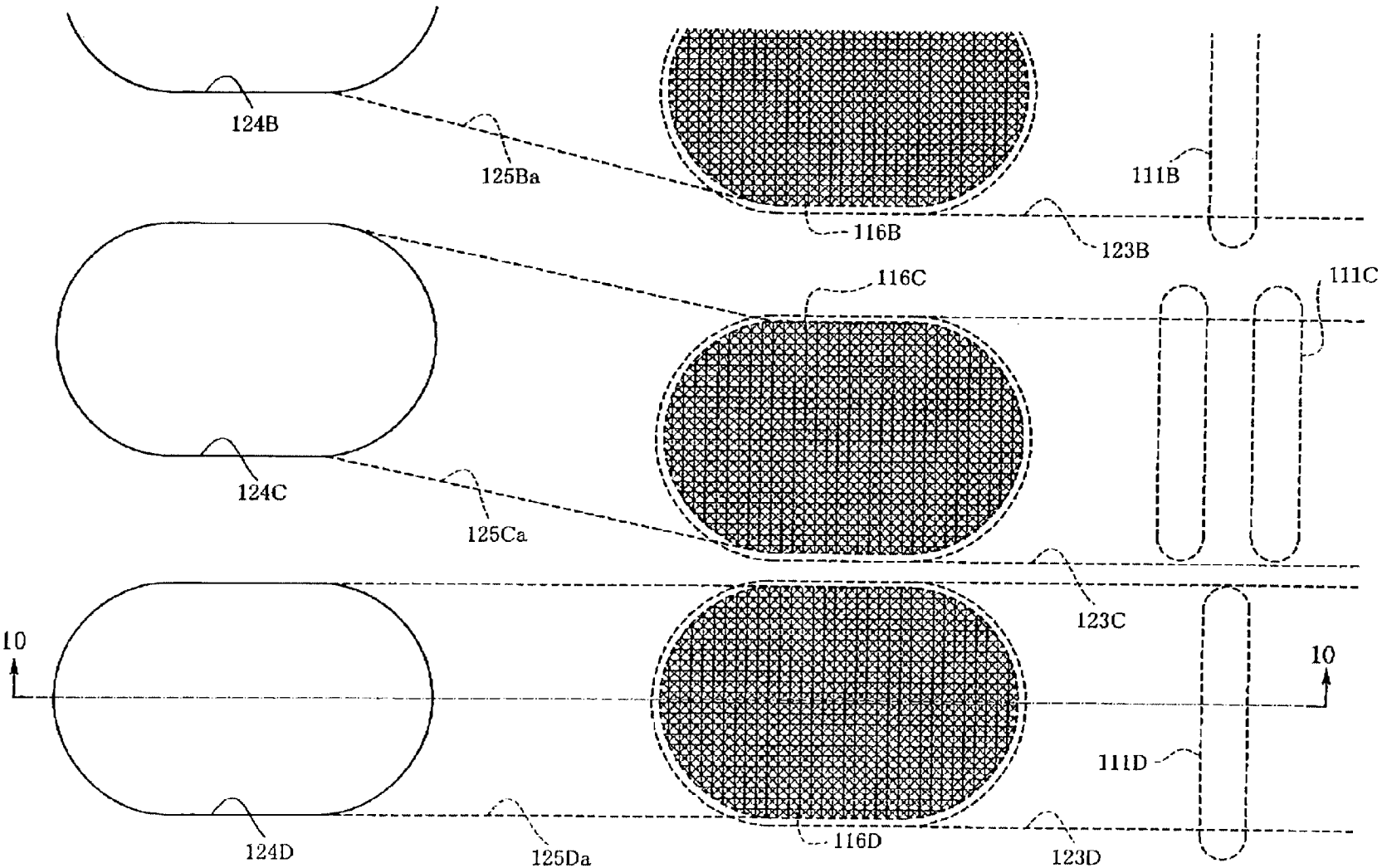
FIG. 9 is a plan view corresponding to FIG. 3, and showing a portion of a cavity unit of the ink-jet recording head of FIG. 7 that is around a plurality of ink-introducing passages.
Figure 10:
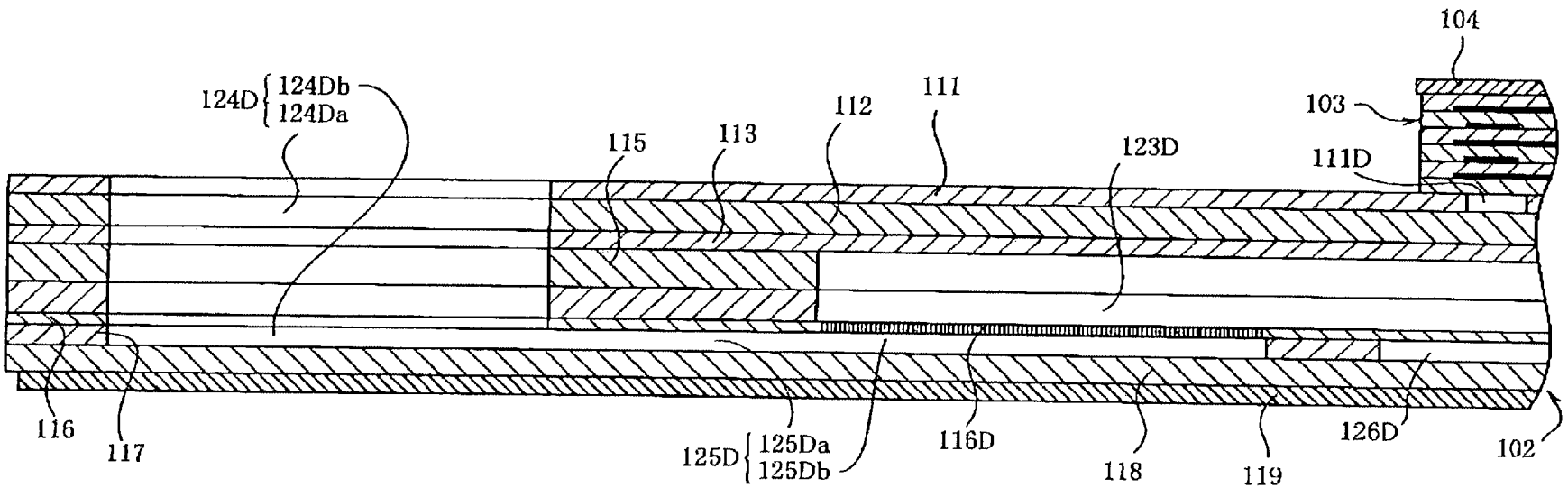
FIG. 10 is a cross-section view corresponding to FIG. 4B, and showing the cavity unit taken along 10-10 in FIG. 9.

As shown in FIGS. 9 and 10, one of lengthwise opposite end portions of each of the five ink manifolds 123A1, 123A2, 123B, 123C, 123D communicates with a corresponding one of four ink-supply sources (not shown) via a corresponding one of four ink-introducing passages 124A, 124B, 124C, 124D and a corresponding one of five communication passages 125A1, 125A2, 125B, 125C, 125D. A downstream side end portion of each of the five communication passages 125A1, 125A2, 125B, 125C, 125D with respect to the direction of flow of the corresponding ink communicates with a corresponding one of the five ink manifolds 123A1, 123A2, 123B, 123C, 123D via a corresponding one of five filter portions 116A1, 116A2, 116B, 116C, 116D that removes foreign matters present in the corresponding ink. The ink-introducing passage 124A corresponding to the black ink communicates with the two communication passages 125A1, 125A2; and the three ink-introducing passages 124B, 124C, 124D corresponding to the cyan ink, the yellow ink, and the magenta ink, respectively, communicates with the three communication passages 125B, 125C, 125D, respectively. As shown in FIGS. 9 and 10, each of the five communication passages 125A1, 125A2, 125B, 125C, 125D includes a guide passage 125Ba, 125Ca, 125Da, and a communication chamber 125Db. The guide passage of the communication passage 125A and the respective communication chambers of the three communication passages 125A, 125B, 125C are not shown in FIGS. 9 and 10.

Each of the four ink-introducing passages 124A, 124B, 124C, 124D is provided as a group of through-holes formed through respective thickness of the cavity plate 111, the base plate 112, the aperture plate 113, the two manifold plates 114, 115, the filter plate 116, and the damper plate 117; and each of the five guide passages 125Ba, 125Ca, 125Da is provided as an elongate through-hole formed through a thickness of the damper plate 117 such that the each guide passage 125Ba, 125Ca, 125Da is provided at a position lower than a position of a corresponding one of the five ink manifolds 123A1, 123A2, 123B, 123C, 123D and is elongate in a direction in which a corresponding one of the four ink-introducing passages 124A, 124B, 124C, 124D and the corresponding one of the five ink manifolds 123A1, 123A2, 123B, 123C, 123D are distant from each other. As shown in FIG. 10, an upstream-side end portion of each of the five guide passage 125Ba, 125Ca, 125Da communicates with a downstream-side end portion 124Db of a corresponding one of the four ink-introducing passages 124A, 124B, 124C, 124D, and the downstream-side end portion of each of the five guide passages 125Ba, 125Ca, 125Da communicates with a corresponding one of the five filter portions 116A1, 116A2, 116B, 116C, 116D via a corresponding one of the five communication chambers 125Db. Thus, for each of the four inks, a corresponding one of the four ink-introducing passages 124A, 124B, 124C, 124D and a corresponding one or two of the five guide passages 125Ba, 125Ca, 125Da communicate with a corresponding one or two of the five ink manifolds 123A1, 123A2, 123B, 123C, 123D via a corresponding one or two of the five communication chambers 125Db and a corresponding one or two of the five filter portions 116A1, 116A2, 1163, 116C, 116D.

As shown in FIG. 10, the five filter portions 116A1, 116A2, 116B, 116C, 116D are provided as respective portions of the filter plate 116 located under the lower surface of the lower manifold plate 15, such that the five filter portions 116A1, 116A2, 116B, 116C, 116D correspond to respective upstream-side end portions of the five ink manifolds 23A1, 23A2, 23B, 23C, 23D that communicate with the respective downstream-side end portions of the five guide passages 125A1, 124A2, 125B, 125C, 125D. Each of the filter portions 116A1, 116A2, 116B, 116C, 116D may be provided in any of the following manners: (i) a multiplicity of small holes are formed through a thickness of an appropriate portion of the filter plate 116, (ii) a filter member is fitted in a large hole formed through a thickness of an appropriate portion of the filter plate 116, and (iii) the filter plate 116 is obtained by bonding a first plate member having a multiplicity of small holes formed through a thickness thereof and over an entire area thereof and a second plate member having a large hole formed through a thickness of an appropriate portion thereof to each other. Each of the five ink manifolds 123A1, 123A2, 123B, 123C, 123D each as the common ink chamber provides a communication chamber that communicates with a corresponding one of the respective communication chambers 125Cb of the five communication passages 125A1, 125A2, 125B, 125C, 125D via a corresponding one of the five filter portions 116A, 116B, 116C, 116D.

Each of the four ink-introducing passages 124A, 124B, 124C, 124D is for causing a corresponding one of the four inks respectively supplied from the four ink-supply sources (not shown), to flow downward in the direction of stacking of the plates 111 through 119, and is provided at a position off-set from a corresponding one or two of the five filter portions 116A1, 116A2, 116B, 116C, 116D in the direction of flowing of the corresponding ink through a corresponding one or two of the five guide passages 125Ba, 125Ca, 125Da. That is, the downstream-side end portion 124Db of each of the four ink-introducing passages 124A, 124B, 124C, 124D is opposed to the spacer plate 118, and accordingly the ink flowing in the each ink-introducing passage 124A, 124B, 124C, 124D is deflected by the spacer plate 118 so as to flow into a corresponding one or ones of the five guide passages 125Ba, 125Ca, 125Da. Thus, before the ink enters the corresponding filter portion(s) 116A1, 116A2, 116B, 116C, 116D, the ink is guided by the corresponding guide passage(s) 125Ba, 125Ca, 125Da so as to flow in a direction along the lower surface of the filter plate 116 (more strictly, the lower surface of the upstream-side end portion of the filter plate 116) and flow in a direction from a lower side, to an upper side, of the corresponding filter portion(s) 116A1, 116A2, 116B, 116C, 116D.

The inkjet recording head 101 has a plurality of ink-flow paths that start with the ink-introducing passages 124A, 124B, 124C, 124D and end with the ink-ejection nozzles 119B, 119C, 119D. First, each of the four inks flows from a corresponding one of the four ink-introducing passages 124A, 124B, 124C, 124D to a corresponding one or two of the five ink manifolds 123A1, 123A2, 123B, 123C, 123D. Since each of the ink-introducing passages 124A, 124B, 124C, 124D is so formed as to cause the corresponding ink to flow in the direction of stacking of the plate members 111 through 119, the corresponding ink collides with a portion or portions of the spacer plate 118 that correspond(s) to the downstream-side end portion 124Db of the same 124A, 124B, 124C, 124D. Consequently the direction of flow of the corresponding ink is changed from the vertically downward direction to the horizontal direction. That is, the spacer plate 118 functions as an obstacle plate or an ink-flow changing member that not only changes the direction of flowing of each ink but also lowers the velocity of flowing of the same.

In addition, before each of the four inks flows into a corresponding one or ones of the five filter portions 116A1, 116A2, 116B, 116C, 116D, a corresponding one or ones of the five guide passages 125Ba, 125Ca, 125Da located on the upstream side of the corresponding filter portion(s) 116A1, 116A2, 116B, 116C, 116D causes the each ink to flow in the direction along the lower surface of the filter plate 116 and subsequently flow in the direction from the lower side, to the upper side, of the corresponding filter portion(s) 116A1, 116A2, 116B, 116C, 116D, when it enters the corresponding ink manifold(s) 123A1, 123A2, 123B, 123C, 123D. This flow of the ink sweeps the foreign matters away from the lower surface(s) of the corresponding filter portion(s) 116A1, 116A2, 116B, 116C, 116D, and moves the same to respective downstream-side end portion(s) of the corresponding communication chambers 125Db. In addition, owing to gravity, the foreign matters fall downward away from the filter portions 116A1, 116A2, 116B, 116C, 116D. Thus, the foreign matters do not remain around the filter portions 116A1, 116A2, 116B, 116C, 116D, but are accumulated on the upper surface of respective portions of the spacer plate 118 that are opposed to the filter portions 116A1, 116A2, 116B, 116C, 116D. Thus, each of the filter portions 116A1, 116A2, 116B, 116C, 116D can be effectively prevented from being clogged with the foreign matters and accordingly can normally function as a portion of the corresponding ink-flow path for an increased time duration.

Then, each of the four inks is supplied from the corresponding ink manifold(s) 123A1, 123A2, 1233, 123C, 123D to the pressure chambers of the corresponding array(s) 111A1, 111A2, 111B, 111C, 111D via the corresponding restrictor passages 122. When the piezoelectric actuator 103 is driven or operated, the droplet(s) of the each ink is(are) ejected from the pressure chamber(s) of the corresponding array(s) 111A1, 111A2, 111B, 111C, 111D via the corresponding connection passage(s) 121 and the corresponding nozzle(s) 119B, 119C, 119D.

While the fourth embodiment of the present invention has been described by reference to FIGS. 7 through 10, it is to be understood that the present invention may be otherwise embodied.

Figure 11:
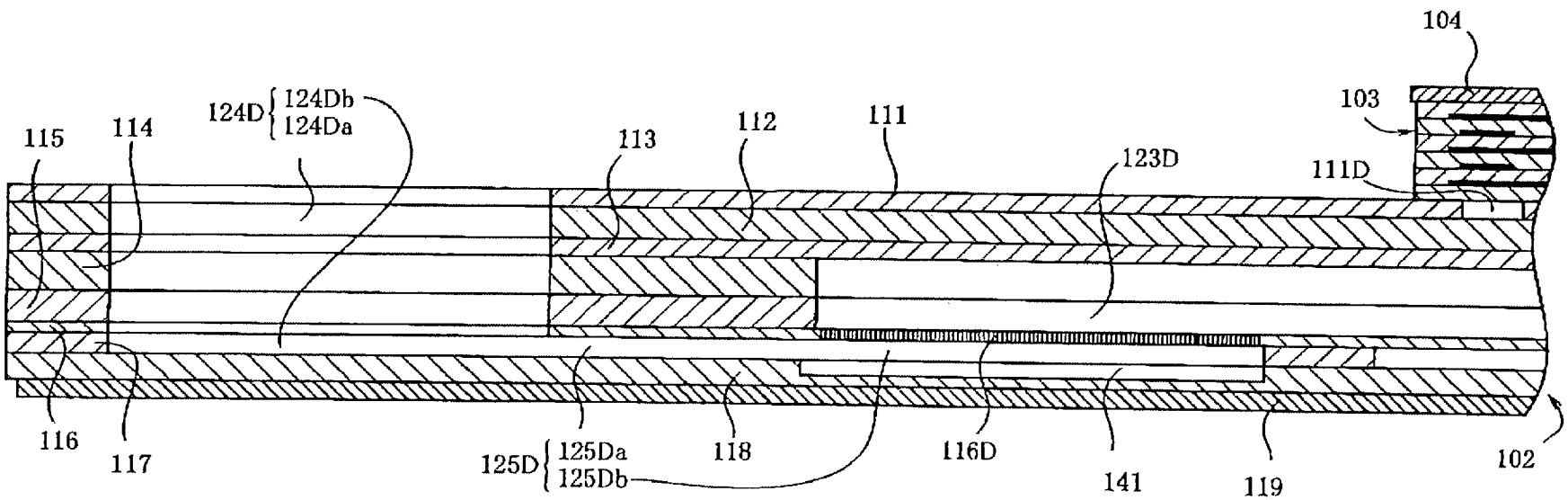
FIG. 11 is a cross-section view corresponding to FIG. 10, and showing another cavity unit of another ink-jet recording head as a fifth embodiment of the present invention.

For example, in the fourth embodiment, each of the five guide passages 125Ba, 125Ca, 125Da of the damper plate 117 only causes the corresponding ink to flow in the direction along the lower surface of the filter plate 116 and into the corresponding filter portion 116A1, 116A2, 116B, 116C, 116D. However, in a fifth embodiment shown in FIG. 11, the spacer plate 118 that is opposite to the filter plate 116 with respect to the damper plate 117 has, in each of respective portions of the upper surface thereof that are opposed to the five filter portions 116A1, 116A2, 116B, 116C, 116D, a foreign-matter trapping portion 141 that is provided in the form of a recess and that traps a large amount of foreign matters. The five foreign-matter trapping portions 141 are opposed to the five filter portions 116A1, 116A2, 116B, 116C, 116D via the respective communication chambers 125Db of the five communication passages 125A, 125A2, 125B, 125C, 125D.

Figure 12:
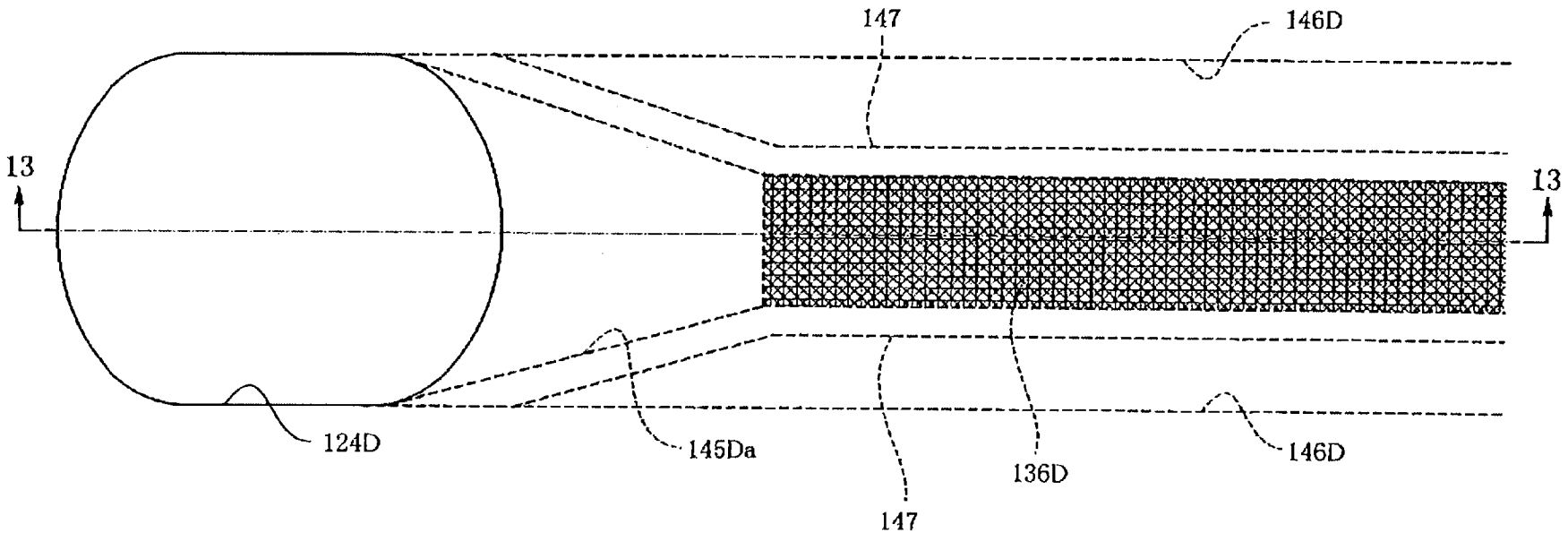
FIG. 12 is a plan view of an ink-introducing passage of another cavity unit of another ink-jet recording head as a sixth embodiment of the present invention.
Figure 13:
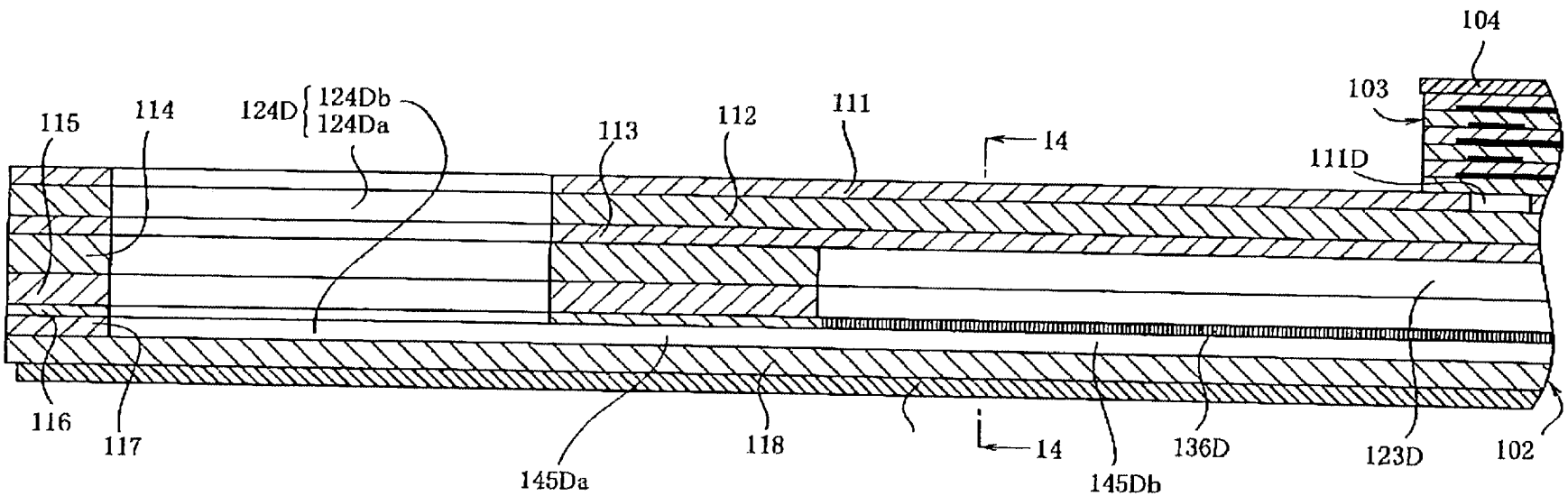
FIG. 13 is a longitudinal cross-section view corresponding to FIG. 10, and showing the cavity unit taken along 13-13 in FIG. 12.
Figure 14:
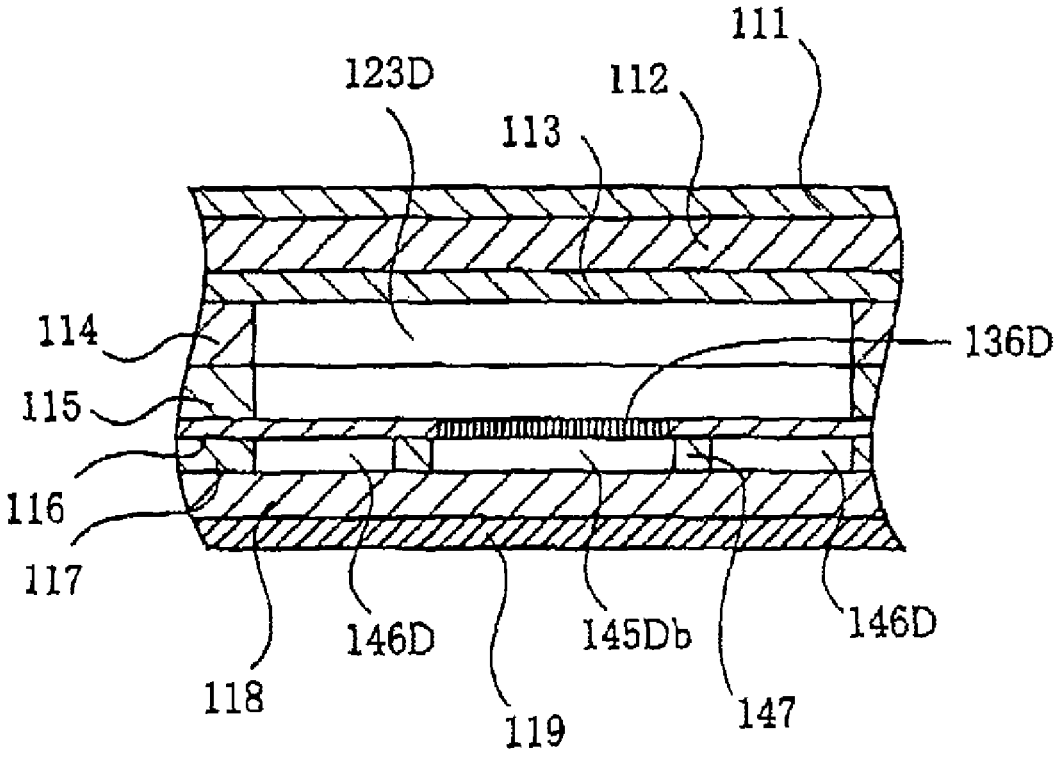
FIG. 14 is a transverse cross-section view of the cavity unit, taken along 14-14 in FIG. 13.

In addition, in the fourth embodiment, each of the five filter portions 116A1, 116A2, 116B, 116C, 116D communicates with only the upstream-end portion of a corresponding one of the five ink manifolds 123A1, 123A2, 123B, 128C, 123D. However, in a sixth embodiment shown in FIGS. 12 through 14, a filter plate 116 has five elongate filter portions (only the elongate filter portion 136D corresponding to the magenta ink is shown), and a damper plate 117 has five elongate communication passages including respective guide passages and respective elongate communication chambers (only the guide passage 145Da and the elongate communication chamber 145Db corresponding to the magenta ink are shown). The five elongate filter portions 136D and the five communication chambers 145Db are elongate in the lengthwise direction of the corresponding ink manifolds 123A1, 123A2, 123B, 123C, 123D. The damper plate 117 additionally has five pairs of elongate damper chambers (only the pair of elongate damper chambers 146D corresponding to the magenta ink are shown) each pair of which is provided on either side of a corresponding one of the five elongate communication chambers 145Db, such that the two elongate damper chambers 146D of the each pair extend parallel to each other and are separated from each other by a pair of elongate separation walls 147. Each 145Da of the five guide passages communicates, at an upstream-side end thereof, with a downstream-side end portion 124Db of a corresponding one 124D of the four ink-introducing passages 124A, 124B, 124C, 124D, and communicates, at a downstream-side end thereof, with a corresponding one 136D of the five elongate filter portions via a corresponding one 145Db of the five elongate communication chambers.

It is to be understood that the present invention may be embodied with other changes and improvements that may occur to a person skilled in the art, without departing from the spirit and scope of the invention defined in the claims.

What is claimed is:

1. A cavity unit for use in an ink-jet recording head, comprising:

a plurality of plate members which are stacked on each other and which have (a) an ink-introducing passage which introduces an ink, (b) a filter portion which removes foreign matters from the introduced ink, (c) a first communication chamber and a second communication chamber, which are provided on either side of the filter portion and communicate with each other through the filter portion, (d) a plurality of nozzles, each of which ejects a droplet of the ink, (e) a plurality of individual ink chambers, each of which outputs the ink to a corresponding one of the nozzles, and (f) a common ink chamber which temporarily stores the ink to be supplied to said each individual ink chamber and comprises the first communication chamber disposed downstream with respect to an ink-flow path along which the ink flows from the ink-introducing passage to said each nozzle, the plate members including:

an individual-ink-chamber plate having the individual ink chambers;

a nozzle plate having the nozzles;

a filter plate including the filter portion; and a guide-passage plate which is provided adjacent to one of opposite surfaces of the filter plate and which has, on an upstream side of the second communication chamber with respect to the ink-flow path, a guide passage which causes the introduced ink to flow, before the ink flows into the second communication chamber, in a first direction along said one of the opposite surfaces of the filter plate, wherein the plurality of plate members are stacked on each other, such that the filter plate and the guide-passage plate are provided between the individual-ink-chamber plate and the nozzle plate and wherein the plate members have a plurality of said ink-introducing passages which are provided in a staggered manner along a plane parallel to the plate members stacked on each other, such that a first group of said ink-introducing passages and a second group of said ink-introducing passages are arranged along a first straight line and a second straight line, respectively, which are parallel to each other and intersect the first direction, and the filter plate has a plurality of said filter portions which are distant from the ink-introducing passages, respectively, in the first direction, and which include a first group of said filter portions arranged along the first straight line, such that the filter portions of the first group are alternate with the ink-introducing passages of the first group, and a second group of said filter portions arranged along the second straight line, such that the filter portions of the second group are alternate with the ink-introducing passages of the second group.

2. The cavity unit according to claim 1, wherein the guide-passage plate is stacked on an upper surface of the filter plate, and the guide passage causes the introduced ink to flow, before the ink flows into the second communication chamber, in the first direction along the upper surface of the filter plate.

3. The cavity unit according to claim 1, wherein the ink-introducing passages extend in a second direction in which the plate members are stacked on each other, and the filter portions are distant from the ink-introducing passages, respectively, in the first direction in which the guide passage extends, and wherein the guide passage and the second communication chamber are formed through a thickness of the guide-passage plate, such that an upstream-side end portion of the guide passage communicates with a downstream-side end portion of the corresponding one of the ink-introducing passages, and a downstream-side end portion of the guide passage communicates with the second communication chamber.

4. The cavity unit according to claim 3, wherein a portion of the filter plate that is located on an upstream side of the upstream-side end portion of the guide passage provides an obstacle portion with which the ink flowing in the the corresponding ink-introducing passage collides such that a direction of flowing of the ink is changed from the second direction to the first direction.

5. The cavity unit according to claim 1, wherein the plate members further include at least one common-ink-chamber plate which has, as at least one through-hole formed through a thickness thereof, the common ink chamber, wherein the individual-ink-chamber plate has, as a plurality of through-holes formed through a thickness thereof, the plurality of individual ink chambers, wherein the nozzle plate, the at least one common-ink-chamber plate, the filter plate, the guide-passage plate, and the individual-ink-chamber plate are stacked on each other in an order of description, wherein the individual-ink-chamber plate and the guide-passage plate further have, as respective through-holes formed through respective thicknesses thereof, the ink-introducing passage, and wherein the filter plate further has a plurality of first connection holes and the guide-passage plate further has a plurality of second connection holes each of which cooperates with a corresponding one of the first connection holes to connect the common ink chamber to a corresponding one of the individual ink chambers so as to supply the ink from the common ink chamber to said corresponding individual ink chamber.

6. The cavity unit according to claim 1, wherein an ink-flow cross-section area of the guide passage gradually increases in a direction from an upstream-side portion thereof toward a downstream-side portion thereof with respect to the ink-flow path.

7. The cavity unit according to claim 1, wherein the guide-passage plate includes a trapping portion which communicates with the second communication chamber, which is opposed, in the first direction, to a downstream-side end portion of the guide passage via the second communication chamber, and which traps the foreign matters present in the introduced ink.

8. The cavity unit according to claim 1, wherein the guide-passage plate is provided on a lower side of the filter plate, and the guide passage causes the introduced ink flowing from the corresponding one of the ink-introducing passages to further flow, before the ink flows into the second communication chamber, in the first direction along a lower surface of the filter plate, and then flows in an upward direction from the lower side of the filter plate to an upper side thereof through the corresponding one of the filter portions.

9. The cavity unit according to claim 1, wherein the plate members further include at least one common-ink-chamber plate which is provided adjacent an other of the opposite surfaces of the filter plate and which has the common ink chamber extending in a third direction in which the individual ink chambers are arranged in at least one array, and wherein said at least one common-ink-chamber plate is provided between the individual-ink-chamber plate and the nozzle plate.

10. The cavity unit according to claim 9, wherein the nozzle plate, the guide-passage plate, the filter plate, said at least one common-ink-chamber plate, and the individual-ink-chamber plate are stacked on each other in an order of description, and wherein the ink-introducing passages are formed as respective through-holes formed through respective thicknesses of the individual-ink-chamber plate, said at least one common-ink-chamber plate, the filter plate, and the guide-passage plate.

11. The cavity unit according to claim 1, wherein the plate members further include a trapping plate including a trapping portion which traps the foreign matters present in the introduced ink, and wherein the trapping plate is opposite to the filter plate with respect to the guide-passage plate and is at least partly opposed to the opposed to at least one of the filter portions via the second communication chamber.

12. The cavity unit according to claim 1, wherein the filter plate includes at least one elastic portion, and the guide-passage plate further has at least one damper chamber which is opposed to said at least one common ink chamber via said at least one elastic portion of the filter plate that is elastically deformable into each of said at least one damper chamber and the common ink chamber.

13. The cavity unit according to claim 12, wherein at least one of the filter portions is elongate along the common ink chamber, and the damper chamber extends parallel to the filter portion.

14. The cavity unit according to claim 1, wherein the plate members further include a damper-chamber plate which has at least one damper chamber which is opposed to the common ink chamber and which is formed as at least one through-hole formed through a thickness of the damper-chamber plate.

15. The cavity unit according to claim 1, wherein the plate members further include a damper-chamber plate which has at least one damper chamber which is opposed to the common ink chamber and which is formed as at least one recess formed in one of opposite surfaces of the damper-chamber plate.

16. An ink-jet recording head, comprising:

the cavity unit according to claim 1; and an actuator which causes the nozzles to eject respective droplets of the ink so as to record an image on a recording medium.

17. The cavity unit according to claim 1, wherein the plurality of plate members comprise (a) said ink-introducing passages each of which introduces an ink, (b) said filter portions each of which removes foreign matters from the ink introduced by a corresponding one of the ink-introducing passages, (c) a plurality of said pairs of first and second communication chambers each pair of which are provided on either side of a corresponding one of the filter portions and communicate with each other through said corresponding one of the filter portions, (d) a plurality of first groups of said nozzles each group of which includes a plurality of nozzles each of which ejects a droplet of the ink introduced by said corresponding one of the ink-introducing passages, (e) a plurality of second groups of said individual ink chambers each group of which includes a plurality of individual ink chambers each of which outputs the ink to a corresponding one of the nozzles of a corresponding one of the first groups, and (f) a plurality of said common ink chambers each of which temporarily stores the ink to be supplied to each of the individual ink chambers of a corresponding one of the second groups, and comprises the first communication chamber of a corresponding one of the pairs with respect to an ink-flow path along which the ink flows from said corresponding one of the ink-introducing passages to each of the nozzles of said corresponding first group, and wherein the individual-ink-chamber plate has the second groups of individual ink chambers, the nozzle plate has the first groups of nozzles, the filter plate includes the filter portions, and the guide-passage plate has the guide passages.

18. An ink-jet recording apparatus, comprising:

a cavity unit including a plurality of plate members which are stacked on each other and which have (a) an ink-introducing passage which introduces an ink, (b) a filter portion which removes foreign matters from the introduced ink, (c) a plurality of nozzles each of which ejects a droplet of the ink, (d) a plurality of individual ink chambers each of which outputs the ink to a corresponding one of the nozzles, and (e) a common ink chamber which temporarily stores the ink to be supplied to said each individual ink chamber, wherein the common ink chamber is provided on a downstream side of the filter portion with respect to an ink-flow path along which the ink flows from the ink-introducing passage to said each nozzle, and wherein when a pressure is applied to an arbitrary one of the individual ink chambers, a corresponding one of the nozzles ejects a droplet of the ink toward a recording medium, the plate members including:

an individual-ink-chamber plate having the individual ink chambers;

a nozzle plate having the nozzles;

a filter plate including the filter portion; and a guide-passage plate which is stacked on the filter plate and which has, on an upstream side of the filter portion with respect to the ink-flow path, a guide passage which causes the introduced ink to flow, before the ink flows into the filter portion, in a direction along an upper surface of the filter plate, wherein the plurality of plate members are stacked on each other, such that the filter plate and the guide-passage plate are provided between the individual-ink-chamber plate and the nozzle plate, wherein the filter plate has a plurality of said filter portions which communicate with the ink-introducing passage in respective opposing directions each of which is perpendicular to a second direction in which the ink-introducing passage extends, and the plate members have a plurality of pairs of said first and second communication chambers corresponding to the plurality of filter portions, respectively, and wherein the guide-passage plate has a plurality of said guide passages which communicate, at respective upstream-side end portions thereof, with a downstream-side end portion of the ink-introducing passage, extend in said respective directions, and communicate, at respective downstream-side end portions thereof, with the respective second communication chambers of the pairs of said first and second communication chambers.

19. An ink-jet recording apparatus, comprising:

a cavity unit including a plurality of plate members which are stacked on each other and which have (a) an ink-introducing passage which introduces an ink, (b) a filter portion which removes foreign matters from the introduced ink, (c) a plurality of nozzles each of which ejects a droplet of the ink, (d) a plurality of individual ink chambers each of which outputs the ink to a corresponding one of the nozzles, and (e) a common ink chamber which temporarily stores the ink to be supplied to said each individual ink chamber, wherein the common ink chamber is provided on a downstream side of the filter portion with respect to an ink-flow path along which the ink flows from the ink-introducing passage to said each nozzle, and wherein when a pressure is applied to an arbitrary one of the individual ink chambers, a corresponding one of the nozzles ejects a droplet of the ink toward a recording medium, the plate members including:

a filter plate including the filter portion;

at least one common-ink-chamber plate which is provided on an upper side of the filter plate and which has the common ink chamber extending in a direction in which the individual ink chambers are arranged in at least one array; and a guide-passage plate which is provided on a lower side of the filter plate and which has a guide passage which causes the introduced ink flowing from the ink-introducing passage to further flow, before the ink flows into the filter portion, in a direction along a lower surface of the filter plate, so that the ink flows from the guide passage into the common ink chamber in an upward direction from the lower side of the filter plate to the upper side thereof through the filter portion, where the guide passage plate comprises at least one damper chamber which corresponds to the common ink chamber.

* * * * *